US012031319B2

(12) United States Patent
Ylikangas et al.

(10) Patent No.: US 12,031,319 B2
(45) Date of Patent: Jul. 9, 2024

(54) SET FOR ASSEMBLING BUILDING ELEMENTS AND COUPLING ELEMENT THEREFORE

(71) Applicant: Välinge Innovation AB, Viken (SE)

(72) Inventors: Roger Ylikangas, Lerberget (SE); Anders Nilsson, Helsingborg (SE); Karl Quist, Höganäs (SE)

(73) Assignee: Välinge Innovation AB, Viken (SE)

( * ) Notice: Subject to any disclaimer, the term of this patent is extended or adjusted under 35 U.S.C. 154(b) by 781 days.

(21) Appl. No.: 16/713,293

(22) Filed: Dec. 13, 2019

(65) Prior Publication Data

US 2020/0308824 A1 Oct. 1, 2020

(30) Foreign Application Priority Data

Mar. 25, 2019 (EP) ..... 19165028
Nov. 15, 2019 (SE) ..... 1951321-7

(51) Int. Cl.
*E04B 1/38* (2006.01)
*E04B 1/18* (2006.01)

(52) U.S. Cl.
CPC ..... *E04B 1/388* (2023.08); *E04B 1/185* (2013.01)

(58) Field of Classification Search
CPC .. E04B 1/40; E04B 1/185; E04B 1/388; E04F 13/0814; E04F 15/02044; E04F 13/0826
See application file for complete search history.

(56) References Cited

U.S. PATENT DOCUMENTS 2,316,424 A 4/1943 Hasenburger et al.
2,511,074 A * 6/1950 Miller ..... E04F 13/0814 52/537

(Continued)

FOREIGN PATENT DOCUMENTS

AU 2013205775 A1 * 11/2013 ..... E04B 1/40
BE 1015873 A6 10/2005

(Continued)

OTHER PUBLICATIONS

International Search Report and Written Opinion issued in PCT/SE2019/051278, Mar. 4, 2020, ISA/SE Patent-och registreringsverket, Stockholm, SE, 15 pages.

(Continued)

*Primary Examiner* — Rodney Mintz
(74) *Attorney, Agent, or Firm* — Boone IP Law

(57) ABSTRACT

A set including a coupling element, a first building element, a first building panel and a second building panel, wherein the coupling element is configured for assembling the first building panel and the second building panel to the first building element, wherein the coupling element includes a primary coupling portion configured to cooperate with a first mechanical locking system of a first edge of the first building element to thereby lock the coupling element from displacement along a secondary axis and a perpendicular tertiary axis each being orthogonal the primary axis; wherein the coupling element includes a secondary coupling portion extending in a direction along the tertiary axis and configured to cooperate with a second mechanical locking system of the second building panels, wherein the second locking system is configured for locking the first and second panels by a folding displacement of the second panel about its second edge.

15 Claims, 18 Drawing Sheets

(56) References Cited

U.S. PATENT DOCUMENTS

| | | | | | |
|---|---|---|---|---|---|
| 2,620,906 | A * | 12/1952 | Ketchum, Jr. | E04F 13/0814 | 24/561 |
| 2,857,995 | A * | 10/1958 | Boulton | E04F 13/0814 | 52/489.1 |
| 3,388,518 | A * | 6/1968 | Scott | E04F 13/0814 | D8/384 |
| 3,713,264 | A * | 1/1973 | Morgan, Jr. | E04F 15/04 | 52/480 |
| 6,279,286 | B1 * | 8/2001 | Ichihashi | E04F 13/0826 | 52/489.1 |
| 7,748,188 | B2 * | 7/2010 | Ito | E04F 13/0846 | 403/381 |
| 9,850,667 | B2 * | 12/2017 | Engstrom | E04B 9/26 | |
| 10,253,507 | B1 * | 4/2019 | Bilge | E04F 13/0807 | |
| 10,428,532 | B2 * | 10/2019 | Smart | E04F 13/0894 | |
| 11,326,355 | B2 * | 5/2022 | Bergelin | E04F 15/102 | |
| 2013/0283720 | A1 * | 10/2013 | Pervan | E04F 15/02038 | 52/588.1 |
| 2017/0030086 | A1 | 2/2017 | Lopez | | |
| 2017/0268237 | A1 * | 9/2017 | Suzuki | E04F 13/0832 | |
| 2017/0314278 | A1 * | 11/2017 | Lee | E04G 23/0285 | |
| 2018/0334809 | A1 * | 11/2018 | Smart | E04F 13/0846 | |
| 2019/0211856 | A1 * | 7/2019 | Getsiv | F16B 5/0607 | |
| 2020/0131780 | A1 | 4/2020 | De Rick | | |
| 2020/0408230 | A1 * | 12/2020 | Getsiv | F16B 5/065 | |
| 2021/0277665 | A1 * | 9/2021 | Bilge | E04F 13/081 | |
| 2022/0170275 | A1 * | 6/2022 | Ylikangas | E04F 13/0894 | |

FOREIGN PATENT DOCUMENTS

| | | | | | |
|---|---|---|---|---|---|
| CA | 2969434 | A1 * | 1/2018 | E04B 1/40 | |
| CH | 601589 | A5 * | 7/1978 | E04F 13/0826 | |
| CH | 610386 | A * | 4/1979 | E04F 13/0826 | |
| CN | 104220682 | A | 12/2014 | | |
| CN | 106049804 | A | 10/2016 | | |
| DE | 1 659 937 | A1 | 1/1971 | | |
| DE | 3032343 | A1 * | 3/1982 | E04F 13/0826 | |
| DE | 3046297 | A1 * | 7/1982 | E04F 15/02 | |
| DE | 19506813 | A1 * | 6/1996 | E04F 13/0826 | |
| DE | 202 00 268 | U1 | 3/2002 | | |
| DE | 102005058105 | B3 * | 2/2007 | E04F 13/0826 | |
| DE | 202010008983 | U1 * | 2/2011 | E04F 13/0805 | |
| DE | 10 2010 039 268 | A1 | 4/2012 | | |
| DE | 102010039268 | A1 | 4/2012 | | |
| DE | 102013106251 | A1 * | 12/2014 | E04F 15/02044 | |
| DE | 202017102839 | U1 * | 7/2017 | E04B 1/40 | |
| EP | 550882 | A1 * | 7/1993 | E04F 13/0826 | |
| EP | 3219868 | A1 * | 9/2017 | E04B 1/40 | |
| EP | 3272964 | A1 * | 1/2018 | E04B 1/40 | |
| EP | 3 321 441 | A1 | 5/2018 | | |
| EP | 3321441 | B1 | 5/2018 | | |
| ES | 2 448 190 | A1 | 3/2014 | | |
| ES | 2 504 665 | A1 | 10/2014 | | |
| JP | 3146012 | U * | 10/2008 | E04F 13/0826 | |
| JP | 2013-044102 | A | 3/2013 | | |
| KR | 101260667 | B1 * | 5/2013 | E04B 1/40 | |
| KR | 20130005061 | U * | 8/2013 | | |
| WO | WO-2007051934 | A1 * | 5/2007 | E04F 15/02 | |
| WO | WO 2011/006813 | A2 | 1/2011 | | |
| WO | WO-2012020093 | A2 * | 2/2012 | E04F 13/0826 | |
| WO | WO 2012/056074 | A1 | 5/2012 | | |
| WO | WO-2017034455 | A1 * | 3/2017 | E04B 9/0435 | |
| WO | WO 2019/003100 | A1 | 1/2019 | | |
| WO | WO-2019145106 | A1 * | 8/2019 | E04F 13/0826 | |
| WO | WO-2019217994 | A1 * | 11/2019 | E04F 15/02044 | |

OTHER PUBLICATIONS

Extended European Search Report issued in EP 19165028.2, Oct. 2, 2019, European Patent Office, Munich, DE, 8 pages.

Ylikangas, Roger, et al., U.S. Appl. No. 17/456,406 entitled "Set for Assembling Building Elements and Connecting Device Therefore," filed in the U.S. Patent and Trademark Office Nov. 24, 2021.

First Office Action issued on Jul. 25, 2022 by the State Intellectual Property Office of People's Republic of China in corresponding Chinese Patent Application No. 2019800494698.9. (15 pages).

First Search Report issued on Jul. 19, 2022 by the State Intellectual Property Office of People's Republic of China in corresponding Chinese Patent Application No. 2019800494698.9. (2 pages).

* cited by examiner

SET FOR ASSEMBLING BUILDING ELEMENTS AND COUPLING ELEMENT THEREFORE

CROSS REFERENCE TO RELATED APPLICATIONS

The present application claims the benefit of European Application No. 19165028.2, filed on Mar. 25, 2019, and claims the benefit of Swedish Application No. 1951321-7, filed on Nov. 15, 2019. The entire contents of each of European Application No. 19165028.2 and Swedish Application No. 1951321-7 are hereby incorporated herein by reference in their entirety.

TECHNICAL FIELD

Embodiments of the present inventive concept pertain to a coupling element for assembling building panels to a building element and a set comprising the coupling element.

BACKGROUND

Known systems for assembling building panels typically comprise various types fastening rails mounted to a fixed structure, such as a wall or like. Wall panels to be assembled are typically arranged to extend transverse the rails. A mounting device or like is fixedly attached to the rail or to the wall panel and provides a link between the rails and the wall panel.

Known systems are however associated with shortcomings in terms of flexibility of the system and which is time consuming and tedious to assemble. As such, there is room for improvements in the technical field.

SUMMARY

It is an object of certain embodiments of the present inventive concept to provide improvements over the above described techniques and known art.

It is a further object of certain embodiments of the present inventive concept to facilitate ease and/or speed of coupling building panels.

It is a still further object of certain embodiments of the present inventive concept to provide a device for coupling of building panels which is cost efficient and easy to produce.

It is another objected of certain embodiments of the present inventive concept to provide a coupling element which allows thermal expansion of coupled panels, such as a wall.

It is further objected of certain embodiments of the present inventive concept to provide a coupling element which facilitates improved economy of space.

Definition of Some Terms

In the following text, the surface facing towards the user in assembled state and typically intended to be a visible surface of the installed building panel is called "proximal surface", while the opposite side of the building panel facing the subfloor, wall or like is called "distal surface". "Horizontal plane" relates to a plane, which is parallel to the proximal surface. Directly adjoining upper parts of two neighboring joint edges of two joined floor panels together define a "vertical plane" perpendicular to the horizontal plane. The outer parts of the floor panel at the edge of the floor panel between the proximal surface and the distal surface are called "joint edge". As a rule, the joint edge has several "joint surfaces" which can be vertical, horizontal, angled, rounded, beveled etc. These joint surfaces exist on different materials, for instance laminate, fiberboard, wood, plastic, metal (in particular aluminum) or sealing materials.

By "vertical locking" is meant locking in the direction normal to the proximal surface, such as parallel to the vertical plane when the building panels are assembled as a floor or parallel the horizontal plane when the building panels are assembled as a wall. By "horizontal locking" is meant locking in the plane of the proximal surface in a direction transverse an edge, such as a long edge, and away from the panel.

By "up" is meant towards the proximal surface, by "down" towards the distal surface, by "inwardly" mainly horizontally towards an inner and centre part of the panel and by "outwardly" mainly horizontally away from the centre part of the panel.

By "locking" or "locking system" are meant cooperating connecting means which interconnect the floor panels vertically and/or horizontally. By "mechanical locking system" is meant that locking can take place without glue. Mechanical locking systems can in many cases also be joined by glue.

By "vertical locking surfaces" is meant the upper and lower cooperating tongue surfaces in the tongue in a first edge cooperating with upper and lower cooperating tongue groove surfaces in the tongue groove in an adjacent second edge locking the adjacent edges vertically.

By "horizontal locking surfaces" is meant an essentially vertical upper tongue groove edge and a locking element in the second edge cooperating with an essentially vertical upper tongue edge and a locking groove in the adjacent first edge, the cooperating horizontal locking surfaces lock the adjacent edges horizontally.

By "locking groove side" is meant the side of the floor panel in which part of the horizontal locking is a locking groove whose opening faces to the rear side. By "locking element side" is meant the side of the floor panel in which part of the horizontal locking is a locking element, which cooperates with the locking groove.

By "decorative surface layer" is meant a surface layer, which is mainly intended to give the floor its decorative appearance. "Wear resistant surface layer" relates to a high abrasive surface layer, which is mainly adapted to improve the durability of the front side. A "decorative wear resistant surface layer" is a layer, which is intended to give the floor its decorative appearance as well as improve the durability of the front side. A surface layer is applied to the core.

At least some of these objects and other objects and advantages that will be apparent from the description have been achieved by embodiments of the present inventive concept.

In a first aspect, there is provided a set comprising a coupling element, a first building element, a first building panel and a second building panel, wherein the coupling element is configured for assembling the first building panel and the second building panel to the first building element, wherein the coupling element comprises a primary coupling portion extending in a direction along a primary axis and configured to cooperate with a first mechanical locking system of a first edge of the first building element extending along the primary axis, to obtain an assembled state therewith by means of a folding displacement of the coupling element about the primary axis to thereby lock the coupling element from displacement along a secondary axis and a perpendicular tertiary axis each being orthogonal the primary axis; and wherein the coupling element comprises a secondary coupling portion extending in a direction along the tertiary axis and configured to cooperate with a second mechanical locking system of respective first and opposite second edges of the first and second building panels, wherein the second locking system is configured for locking the first and second panels in a direction transverse of the plane of the proximal surface by means of a folding displacement of the second panel about or along its second edge;

wherein the second locking system of the second edge comprises a locking groove which opens in a direction along the tertiary axis in assembled state of the first and second panels, the locking groove configured to receive a locking element of the second locking system of the first edge of the first panel, said locking element extending in a direction along the tertiary axis; and wherein said locking element is received in said locking groove by means of said folding displacement of the second panel about or along its second edge to thereby lock the second panel and the first panel from parting away in a direction of the plane of the proximal surface and transverse the second edge of the first panel.

This configuration may facilitate that the second mechanical locking system is utilized for locking the first and second panels from parting away from each other by means of direct engagement between the first and second panels and simultaneously locks the coupling element to the first and second panels by means of direct engagement between the coupling element and the second locking system, in particular the locking system of the first edge of the first panel.

Also, expansion and/or contraction of the panels may be accommodated, e.g. due to moisture or thermal expansion. Thanks to the coupling element being displaceable in a direction along the primary axis while being configured in assembled state with the first building element and the first building panel being displaceable along the secondary axis, a wall assembled by the coupling element according to embodiments of the inventive concept may be a floating wall, i.e. the wall may displace in the direction of the primary axis and in the direction of the secondary axis.

In addition, the wall may be self-supportive in a direction along the primary axis, i.e., neither the first building element nor the coupling element may have to carry any load.

Further, the thickness of the wall comprised of the assembled panels may correspond to the aggregated thickness of the first and first panel, which may thus be minimized by selecting panels of a desired thickness.

Still further, by means of the set according to the inventive concept, a wall may be assembled using identically formed panels.

Also, the coupling element according to the inventive concept may be used to assemble a wall comprising visible panels arranged in either of a horizontal or vertical orientation without modification of the coupling element.

In one embodiment, the secondary coupling portion may comprise a first portion extending along the tertiary axis and a contiguous second portion extending along the primary axis in assembled state, said second portion configured to engage with the first edge of the first panel, preferably the locking element of the first building panel. This configuration may facilitate that the coupling element may lock the first edge of the first panel from displacing in a direction along the tertiary axis, such as away from the coupling element and thus prevent the first panel from folding, for example about its second axis being opposite the first edge.

The second portion may be configured to, in assembled state, engage with a top surface, in the direction of the tertiary axis, of the locking element of the first edge of the first panel. Thereby, the second portion may be configured to at least partially extend in parallel and in abutment with the top surface in a direction along the primary axis.

Thereby, the secondary coupling portion is configured to cooperate with the secondary locking system.

Thereby, the coupling element may cooperate with the second locking system at a position between the respective proximal surface and the distal surface of the first and second panel, in assembled state. Thereby, the coupling element, in particular the second portion, may not be visible when viewing the proximal surfaces of the first and second panels in assembled state. This provides for a more esthetical wall.

The top surface may extend in a direction along the primary axis between the proximal surface and the distal surface of the first panel.

In one embodiment, the first portion may be configured to extend between, preferably clamped between, an outermost edge surface of the first edge of the first building panel, and an outer edge surface of the second building panel, in assembled state of the first and second panels. Thereby, the second portion may engage with the second locking system at a position between the proximal surface and the distal surface of the first panel, such as with the locking element.

Thereby, the secondary coupling portion is configured to cooperate with the secondary locking system.

The locking groove may be configured to receive the second portion. By configuring the locking groove to receive the second portion, the second portion may be disposed interspaced, preferably clamped, between the locking groove and the locking element of the first edge of the first panel.

Thereby, the secondary coupling portion is configured to cooperate with the secondary locking In one embodiment, the first locking system and the second locking system are essentially identical or identical locking systems. For example, the aspects of the first locking system may be configured to lock with aspects of the second locking system. Thereby, a panel essentially identical the first panel may have the function of the first building element, i.e. the first building element may be interchangeable with a panel essentially identical the first building panel. The set thereby facilitates improved flexibility of a system comprising the set according to the inventive concept.

The first building element may be provided in shape of a joist and/or a building panel, such as a floor panel, a wall panel, a ceiling panel. Thereby, floor panels comprising the second locking system may be used to assemble a floor, a wall or a ceiling by means of the set.

In one embodiment, the first edge of the first building element may extend from a proximal surface to a distal surface of the first building element and may face in a direction generally in the plane of the secondary axis and the primary axis towards the first coupling portion in the assembled state. Thereby, the coupling element may engage with the first building element while being arranged side by side with the first building element, having the first or second primary coupling portion arranged adjacent and opposing the first or second edge of the first building panel. This configuration facilitates, i.a., that the distal surface of the first panel may abut the proximal surface of the first building element, in assembled state of the first building panel to the first building element by means of the coupling element.

The coupling element may comprise a main body, the body comprising the primary coupling portion, the body being arranged on a distal side of said proximal surface of the first building element in assembled state. It is thereby facilitated that the coupling element does not add any thickness to the aggregated thickness of the assembled wall comprising the first building element, the first and second panels.

In one embodiment, the secondary coupling portion may extend from the body to a proximal side of said proximal surface of the first building element in engaged state. It is thereby facilitated that the coupling element may engage with the second locking system while not adding any thickness to the aggregated thickness of the assembled wall comprising the first building element, the first and second panels.

A second edge of the second building panel may comprise a locking tongue configured to be received in a tongue groove of the first edge of the first building panel in response to or by means of said folding displacement of the second building panel about its second edge for locking of the second panel to the first panel in a direction transverse of the plane of the proximal surface. It is thereby facilitated that the second building panel may be assembled to the first building panel at any given position along the first edge of the first building panel by means of folding to thereby lock the second panel and the first panel from separating.

In one embodiment, a first primary coupling portion may comprise a locking groove which opens in a direction along the tertiary axis in engaged state of the first panel and being configured to receive a locking element of the first edge of the first building element by means of a folding displacement of the coupling element about the primary axis for locking of the coupling element and the first building element from parting in a direction along the secondary axis, wherein the locking element extends in a direction along the tertiary axis. It is thereby facilitated that the first coupling portion may be assembled to the first building element at any given position along the first edge of the first building element by means of folding to thereby be displaceable along the first edge, while being configured in assembled state.

A second primary coupling portion of the coupling element may comprise a locking tongue configured to be received in a tongue groove of the second edge of the first building element by means of a folding displacement of the coupling element about the primary axis for locking of the coupling element and the first building element from parting in a direction along the secondary axis. It is thereby facilitated that the second coupling portion may be assembled to the first building element at any given position along the second edge of the first building element by means of folding to thereby be displaceable along the second edge, while being configured in assembled state.

In one embodiment, the primary coupling portion is configured to engage with the first edge and/or second edge of the first building element by means of a folding or pivoting displacement of the coupling element about the primary axis. By configuring the coupling element to engage with an edge of a building panel, such as the first edge of the first building element, by means of a folding or pivoting displacement of the coupling element in an engagement direction, the coupling element may engage with the edge portion in a releasable manner, i.e. releasably engaged. Consequently, the coupling element may be disengaged by a folding displacement opposite the engagement direction. Further, the coupling element may engage in a non-invasive manner i.e. the outer surface of the entity of the coupling element may be arranged completely external the outer surface of the entity of the first building element in engaged state; the coupling element may engage with the edge portion while being arranged external the edge and/or building panel. Thus, the assembling of panels by means of the coupling element may not cause permanent marks or damage to the panels. In addition, a step of engaging and disengaging the coupling element and the edges made easy and fast.

The folding or pivoting displacement may comprise folding about the primary axis. By configuring the coupling element to engage with the edge by means of a folding displacement about the primary axis, which may be arranged parallel the first edge in engaged state, it may be facilitated that the coupling element is displaceable along the first edge while engaging with the edge portion. This configuration may facilitate that the coupling element may be configured in engagement with an edge of a panel, such as the first or second edge of the first building element and simultaneously be displaced along the primary axis. This configuration may facilitate that the coupling element can be configured in an engage state with an edge of a panel in the primary plane, and then displaced along the first edge and/or the primary axis and/or in the primary plane to the extent that a secondary coupling portion engages with an edge of a first panel in the secondary plane displaced from the primary plane in a direction of the tertiary axis, to thereby lock the first panel from pivoting, such as locking the first panel in the second plane and/or lock the first edge of the first panel in a direction along the tertiary axis away from the coupling element.

In one embodiment, the primary coupling portion may be configured to cooperate a locking element of the first edge for locking displacement of the coupling element along the secondary axis.

The engaging of the coupling element with the first edge of the first building element may comprise the locking element of the primary coupling portion and the locking element of the first building element being configured to extend in opposite directions along the tertiary axis and mutually overlap in engaged state of the first building element.

In one embodiment, the first building element and/or the first panel may comprise a mechanical locking system for mechanical locking of one or more of similar adjacent panels in a direction of the plane of the first and/or distal surface. By providing panels with an integrated mechanical locking system, such as for horizontal locking in a direction of the plane of the proximal and/or distal surface and/or vertical locking normal the plane of the proximal and/or distal surface, the panels may be adapted to be laid as a floor, such as a floating floor, with the mechanical locking system functioning as a horizontal locking system, and/or as a wall, such as a floating wall, with the mechanical locking system functioning as a vertical locking system.

The coupling element may be configured to cooperate with the mechanical locking system of the first building element and/or the first and second panel. By configuring the coupling element to cooperate with the inherent or integrated mechanical locking system of a panel, such as the first building element and/or the first and the second panel, the coupling element may utilize the mechanical locking system of building elements, such as panels, to be coupled, to couple said building elements. Thus, the coupling element may be adapted to cooperate with the applicable mechanical locking system. The coupling element, in particular the primary coupling portion and/or the secondary coupling portion may be adapted to cooperate with the applicable mechanical locking system by being formed to correspond to one or more of the edges of the mechanical locking system, such as the first edge and/or the second edge of the first building element and/or first and second panel.

The first building element may comprise a first mechanical locking system for locking two similar first building elements.

The first and second panel may comprise a second mechanical locking system for locking the panels.

The first and/or the second locking system may be formed by one or more of the edges of the respective panels.

The first mechanical locking system and/or the second mechanical locking system may be formed in the core of the panel, for example by means of mechanical cutting, such as with one or more rotating tools.

The first locking system and the second locking system may be essentially identical or identical. For example, the first and second locking system may be compatible, such that at least one of the edges of the first building elements being capable of locking with an edge of the first and/or second panel by means of direct engagement.

In this disclosure, the term engagement generally refers to direct engagement between two members, such as the first edge of the first panel and the second edge of the second panel.

The locking systems may be formed in respective long-edges of the panel.

The dimensions of the first building element may be different from the dimensions of the first and second panel. For example, the first panel may comprise a greater thickness than the first building element, or vice versa.

In one embodiment, the locking element of the first and/or first panel may form part of the mechanical locking system of the respective panel.

The first building element and said first panel may comprise two essentially identically formed panels, such as panels suitable to be laid as a floor.

In one embodiment, the first secondary coupling portion may be configured to cooperate with a first edge portion of the first panel for locking the first edge of the first panel in the secondary plane and/or locking the first edge portion in a direction along the tertiary axis. By configuring the coupling element to cooperate with the integrated mechanical locking system of a panel, such as the first building element and/or the first panel, the coupling element may utilize the mechanical locking system of panels to be coupled, to couple said panels. Thus, the coupling element may be adapted to cooperate with the applicable mechanical locking system. The coupling element, in particular the primary coupling portion and/or the secondary coupling portion may be adapted to cooperate with the applicable mechanical locking system by being formed to correspond to one or more of the edges of the mechanical locking system, such as the first edge and/or the second edge of the first and/or first panel.

The pivoting or folding of the coupling element may comprise pivoting about the primary axis.

In one embodiment, the coupling element may be configured such that it cannot engage with the first edge of the first building element by linear displacement exclusively in a direction along the secondary axis, such as in a direction transverse the first edge and straight towards the first edge.

In one embodiment, the primary coupling portion may comprise a shape corresponding to a second edge of the first building element and/or a first edge of the first panel.

The secondary coupling portion may be pivotably arranged relative the primary coupling portion.

The coupling element may be configured to be arranged external the first and/or first panel, preferably at an intersection between the first or second edge of the first building element and the first edge of the first panel. This configuration brings about the advantage that the first and first panels may abut, in particular the distal surface of the first panel may abut the proximal surface of the first building element. Thereby the thickness of the wall of assembled panels may be minimized and the economy of space improved.

One of the first edge or second edge of at least one of the first and/or first panel may comprise a locking tongue and the other of the first edge or second edge of the first or first panel may comprise a corresponding tongue groove for receiving a corresponding locking tongue.

In one embodiment, a primary coupling portion may comprise the corresponding locking tongue.

A primary coupling portion may comprise a corresponding tongue groove.

By providing a primary coupling portion with a corresponding locking tongue or tongue groove, the primary coupling portion may establish locking engagement, such as locking in a horizontal plane, with an edge of the first building element comprising the tongue groove, such as the first edge of the first building element.

The secondary coupling portion may be configured to cooperate with a mechanical locking system of a first edge of a further second building panel.

The secondary coupling portion may be configured to cooperate with a shelf provided in a locking element of first edge of a further second building panel.

In one embodiment, the primary coupling portion may comprise the corresponding tongue groove. By providing a primary coupling portion with a corresponding tongue groove, the primary coupling portion may establish locking engagement, such as locking in a horizontal plane, with an edge of the first building element comprising the locking tongue, such as the second edge of the first building element.

Thereby, the coupling element may be configured to engage exclusively with the first edge or exclusively with the second edge or both the first and second edge by comprising two coupling portions, preferably disposed on opposite sides of the coupling element, as will be further explained herein.

The secondary coupling portion may be configured to engage with a mechanical locking system of a first edge of a first building panel extending in a direction along the secondary axis. By forming a secondary coupling portion which cooperates, e.g., mates, receives, hooks on to an edge of the first panel in the secondary plane, thereby the first panel may be locked from pivoting, such as locked from rotation in the second plane. In other words, the first edge of the first panel may be locked from displacement in a direction along the tertiary axis.

In one embodiment, the coupling element may further comprise attachment means, preferably in shape of a through-hole, for attachment of the coupling element to a substrate.

The secondary coupling portion may be pivotably arranged relative the primary coupling portion. By arranging a secondary coupling portion pivotal relative the primary coupling portion, the coupling element may be adapted to the angle of crossing of the first and first panel, i.e. the first edge of the first edge of the first building element and the first edge of the first panel, as will be further elucidated herein.

In one embodiment, the secondary coupling portion comprises an extent parallel with or with an angle relative the secondary axis, such as a 45-degee angle, is engaged state of the first building element.

In one embodiment, the secondary coupling portion may extend in a direction in the plane of the primary axis and secondary axis having a right-angle or a 45-degree angle or an acute angle relative the primary coupling portion extending in a direction along the primary axis. By arranging the primary and secondary coupling portion to extend with a relative angle, the engagement element may be adapted to various intended patterns of the panels of a wall. For example, if the first building element is arranged to extend vertically i.e. the primary plane is a vertical plane, such as when assembling a wall, and the first panel in the parallel secondary plane is intended to be arranged with its long sides in the secondary plane i.e. in a lying manner, and thus crossing the first building element with a right-angle, then the first and second coupling portions of the coupling element may be provided with a right-angle to facilitate coupling of the first and first panel.

A further second secondary coupling portion may be configured to be received in one or more longitudinally extending grooves provided at a distal surface, such as a back side of the first panel and/or a second panel facing the first building element in assembled state. By providing further secondary coupling portions configured to be received in one or more longitudinally extending grooves on a respective back side of the first panel and the second panel facing the first building element in assembled state, the coupling element provides for an improved coupling. Optionally, the coupling element may also couple the first panel to the second panel.

In one embodiment, the coupling element is provided in shape of a clip.

In a second aspect, there is provided a coupling element for coupling a first panel and a second panel to a building element.

Embodiments of the second aspect are generally analogous with embodiments of the first aspect, whereby reference is made to the above.

In a third aspect, the inventive concept pertains to a system for assembling building panels. The system comprising at least one building element and a plurality of building panels provided with respective first and second edges and one or more coupling elements according to the first and/or second aspect.

In a fourth aspect, there is provided a wall comprising the coupling element according to any one of the first or second aspects.

In a fifth aspect, there is provided a method of assembling a first building panel and a second building panel to a first building element, comprising:

providing one or more first building elements, each comprising a first edge;

providing one or more coupling element, said element comprising:

a primary coupling portion extending along a primary axis and being configured to cooperate with a first mechanical locking system of the first edge of the first building element to obtain an engaged state with the first edge by means of a folding displacement of the coupling element about the primary axis;

a secondary coupling portion comprising a first portion extending in a direction along the tertiary axis and a contiguous second portion extending in a direction along the primary axis, the secondary coupling portion configured to cooperate with a second mechanical locking system of the first panel, wherein said second mechanical locking system configured for horizontal and vertical locking with an essentially identical second panel;

folding the coupling element about the primary axis to thereby lock the coupling element from displacement along a secondary axis and a perpendicular tertiary axis each being orthogonal the primary axis; and displacing the coupling element along the first edge of the first building element to a position where the second portion of the second coupling portion engages with a locking element of a first edge of the first panel, the locking element extending in a direction along the tertiary axis;

providing a second building panel comprising a second edge with a locking groove which opens in a direction along the tertiary axis;

folding the second building panel about or along its second edge to thereby arrange said locking element in the locking groove, whereby the first building panel and the second building panel are locked from parting away from each other in a direction of the plane of the proximal surface and transverse the first edge of the first panel.

BRIEF DESCRIPTION OF DRAWINGS

Embodiments of the present inventive concept will by way of example be described in more detail with reference to the appended schematic drawings, which show several embodiments of the inventive concept.

DETAILED DESCRIPTION

Figure 1:
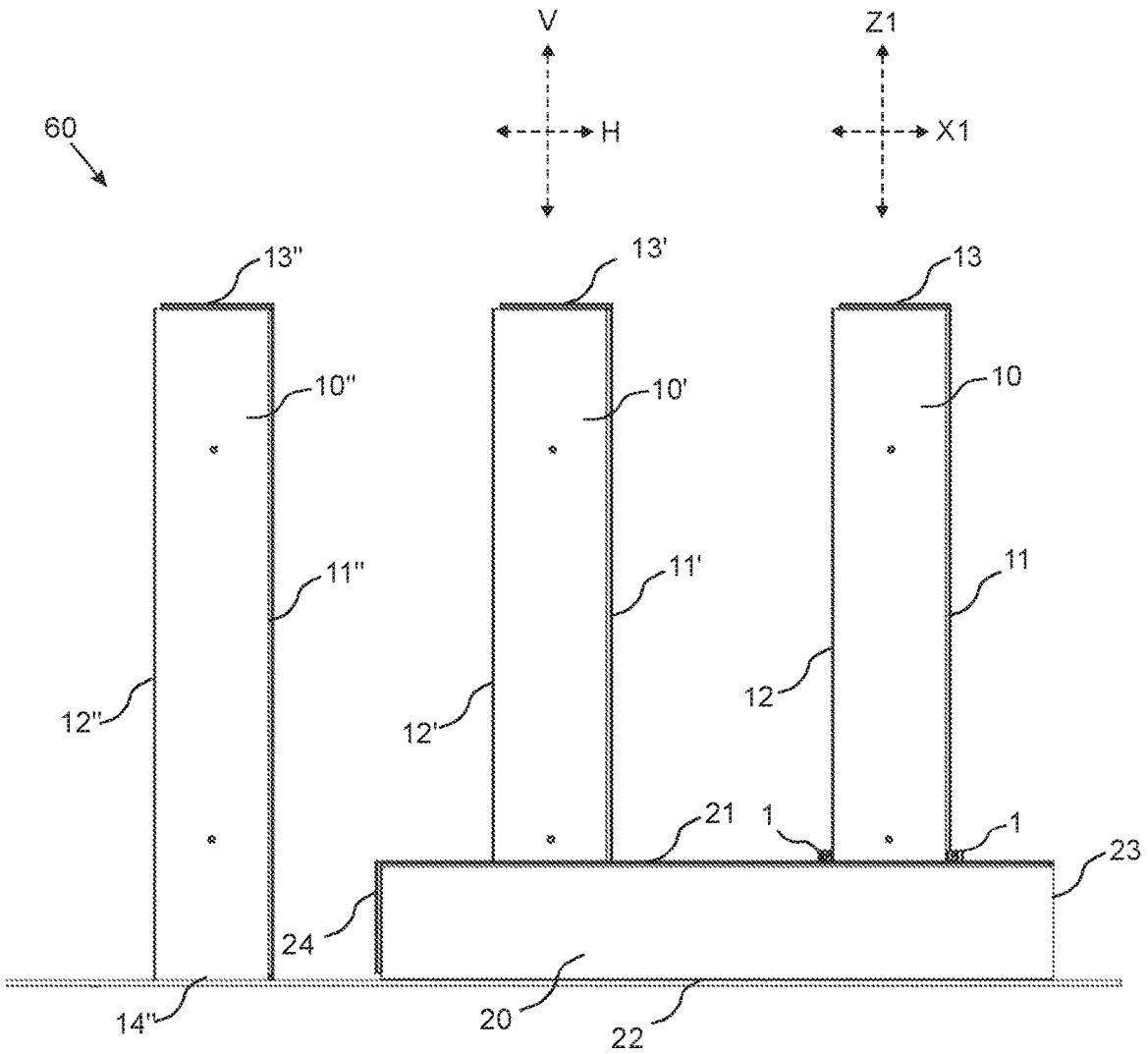
FIG. 1 is a schematic view of a set according to embodiments of the inventive concept.
Figure 2A:
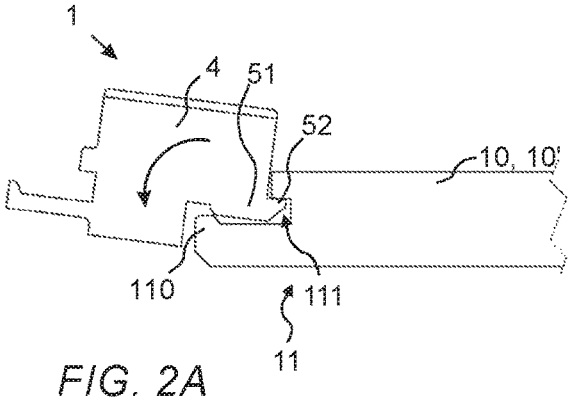
FIGS. 2A-2D are top view of details of the embodiment of FIG. 1.
Figure 2B:
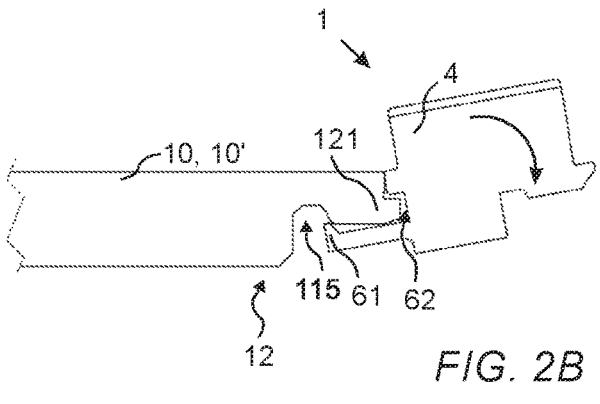

FIGS. 1, 3 and 4A-4B show a coupling element 1 and a set 60, which may be provided in shape of a system, comprising joists which may be provided in shape of building panels 10, 10' 10", building panels which may be provided in shape of wall panels 20, 20' and coupling elements 1. The set 60 may comprise a plurality of building panels, such as a first, second and third building elements 10, 10', 10" and one or more building panels 20, 20'. The first building element 10 and the first building panel 20 may comprise identically formed or similar panels. In FIGS. 1 and 2A-2B, the set 60 is arranged as a wall with the building panels 20, 20' arranged with their respective longitudinal L axes extending along a horizontal plane H, however other configurations are possible within the scope of the inventive concept.

Figure 5A:
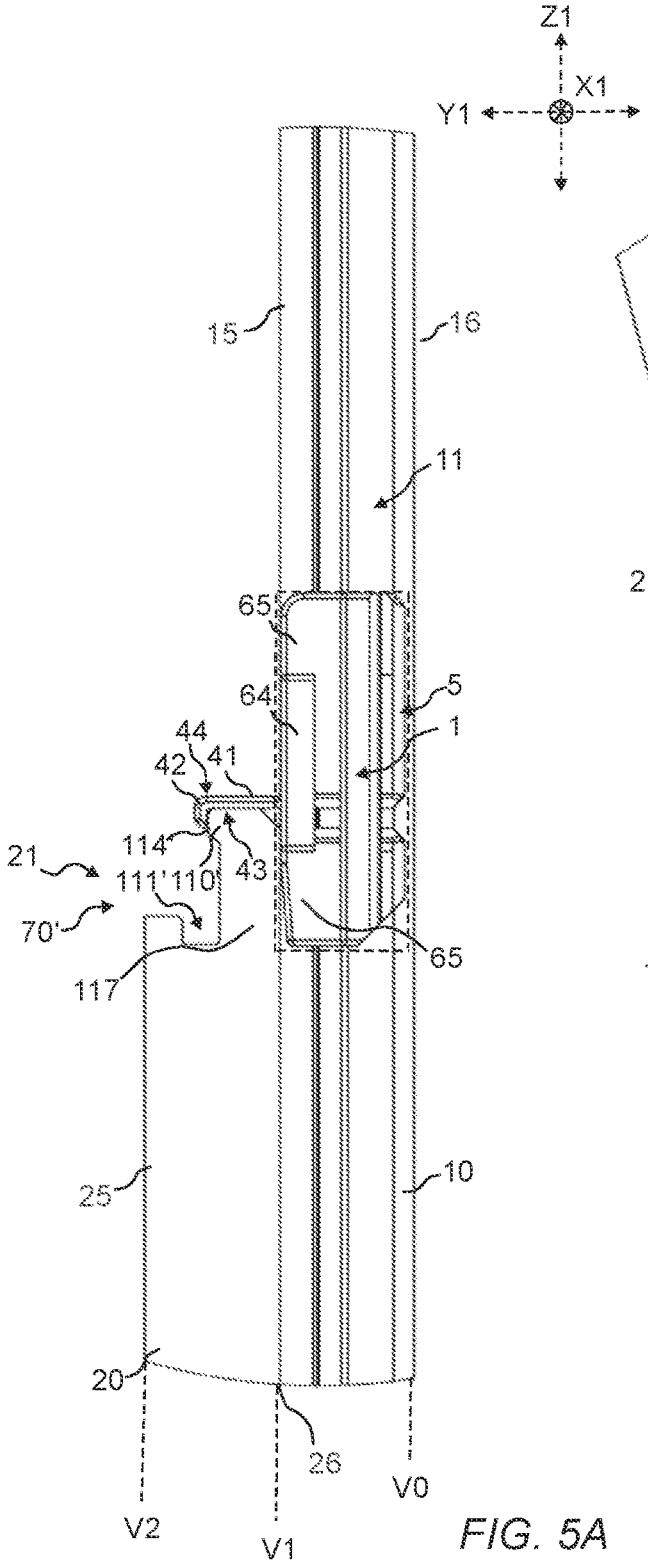
FIG. 5A is a side view of a first building panel arranged in assembled state with a first building element by means of a coupling element, according to an embodiment.
Figure 5B:
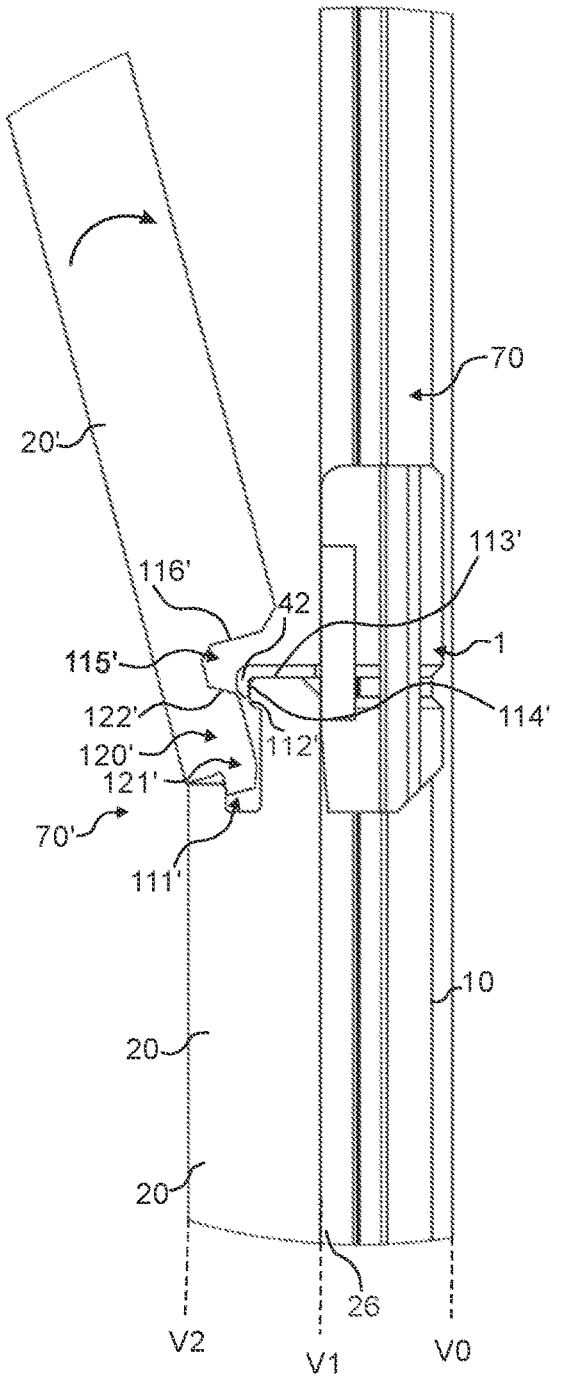
FIG. 5B is a side view of the embodiment of FIG. 5A with a second panel being assembled to the first panel by means of a folding displacement.

A proximal surface 15 of the first building element 10 may be arranged in a primary plane V1 and a proximal surface 25 of the first panel 20 may be arranged in a secondary plane V2 as illustrated in FIGS. 5A-5B. In particular, a respective proximal surface 15, 25 of the first building element 10 and the first panel 20 may be arranged in parallel displaced planes V1,V2 in assembled state, as shown for instance in FIGS. 5A-5B. More in particular, the proximal surface 15 of the first building element 10 may be arranged in the primary plane V1 when in assembled state and the proximal surface 25 of the first panel 20 may be arranged in the secondary plane V2 when in assembled state, such as when coupled by means of the coupling element 1. The first building element 10 and the first panel 20 may be arranged with a relative angle between the respective longitudinal axis thereof, such as transverse each other, as shown, e.g., in FIGS. 1 and 3.

The coupling element 1 may be configured to engage with the first building element 10 to obtain an engaged state therewith. The coupling element 1 may be further configured to engage with the first panel 20 to obtain an engaged state therewith. When at least one coupling element 1 is configured in engaged state with a building element, such as the first building element 10 and/or the first building panel 20, the building element may be referred to as configured in assembled state. Assembled state and engaged state may be used synonymously herein.

The coupling element 1 may be configured to couple two crossing building panels, such as the first building element 10 and the first building panel 20 as depicted in FIG. 1 where the first building panel 20 is arranged with an angle relative the first building element 10, such as transverse the first building element 10 as shown in the exemplary embodiment of FIG. 1.

In some embodiments, the first building element and the first building panels are at least partially essentially identically shaped, the first building element and the first panel may be interchangeable. For example, the first building element 10 may comprise a building element essentially identical the first building panel 20, or a building element essentially identical the first building panel 20 which has been cut in half, such as along its longitudinal extension to comprise one of the first edge 11 or second edge 12 of the first panel 20, which may comprise a mechanical locking system, as will be explained herein. The first building element 10 may be in the shape of a joist or like, having an outer edge facing in the direction of the primary plane V1 and comprising a mechanical locking system 70 for horizontal and vertical locking with other building elements comprising the same locking system 70 by means of folding.

Typically, at least the building panels 20, 20' constitute the visible panels of a wall 59 assembled by means of the set 60, i.e. the first panel 20 is configured to be visible. For example, the first panels 20 may comprise a decorative layer.

In this disclosure, the term "edge" typically refers to an outer edge extending in the thickness direction D of the building element, such as the first building element 10 or the first building panel 20, from the proximal surface 15, 25 to the distal surface 16, 26 of the respective building element. Thus, the edges face in the direction X1 along the plane of the proximal surface and away from the building element, as shown in FIGS. 2A-2D.

Referring to FIGS. 2A-2D, the primary coupling portion 2, 6 may extend along a portion of the first edge 11 in assembled state of the first building element 10.

The primary coupling portion 2, 6 may be configured to engage with a portion of the first edge 11 extending along the primary axis Z1, Z1'.

The coupling element 1 may comprise a generally rectangular shape, when viewed in the direction Y1, such as substantially quadratic.

The coupling element 1 may comprise a proximal side and a distal side. The proximal side may be disposed in the primary plane V1 and essentially flush with the proximal surface of the first building element 10 and extending side-by side with the proximal surface of the first building element in assembled state.

The distal side may be disposed in the plane V0 and essentially flush with the distal surface of the first building element 10.

Figure 2C:
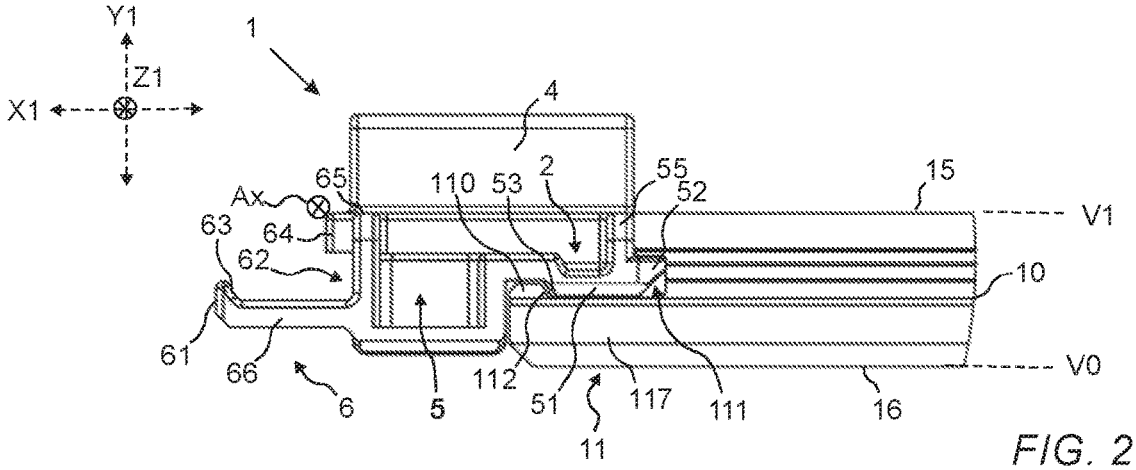
Figure 2D:
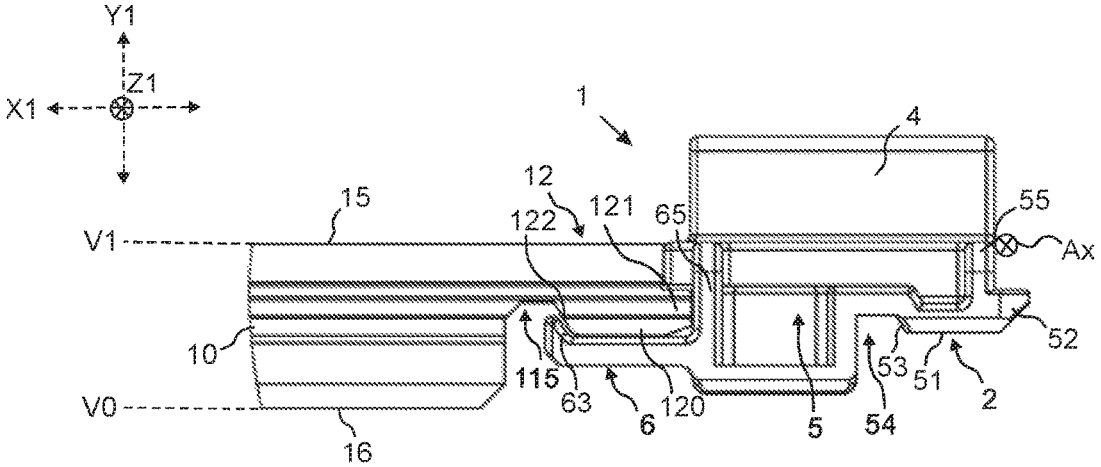

The coupling element 1 may comprise a main body portion 5 and the secondary coupling portion 4 extending from the main body portion 5. The body portion 5 may comprise the first and second primary coupling portions 2, 6. When the coupling element 1 and the first building element 10 are configured in assembled position, as shown in FIGS. 2C-2D, the body 5 may be disposed on a distal side of the proximal surface 15 of the first building element 10. In other words, the body 5 may be arranged between the plane V0 and the primary plane V1. The coupling element 1 and the first building element 10 are thus arranged side by side in the vertical plane or in the plane of the primary axis Z1 and the secondary axis X1. This configuration is beneficial for the economy of space since the aggregated thickness of the wall may correspond to the aggregated thickness of the first building element 10 and the thickness of the first building panel 20.

The secondary coupling portion 4 may extend from the body 5 towards the secondary plane V2, which may correspond to a direction along the tertiary axis Y1 as shown in FIGS. 2C-2D. The proximal surface 25 of the first building panel 20 may be arranged in the secondary plane V2 when the first building panel 20 arranged in assembled position with the first building element 10 and the coupling element 1, as shown in FIGS. 5A-5B.

Figure 7A:
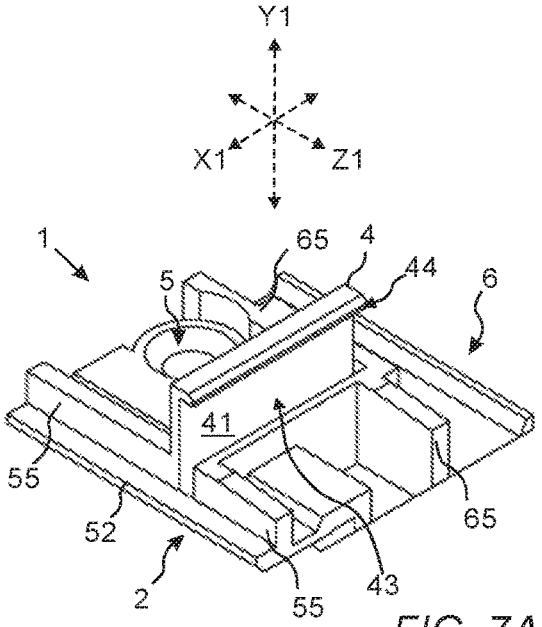
FIGS. 7A-7B show isometric views of a coupling element according to an embodiment.
Figure 7B:
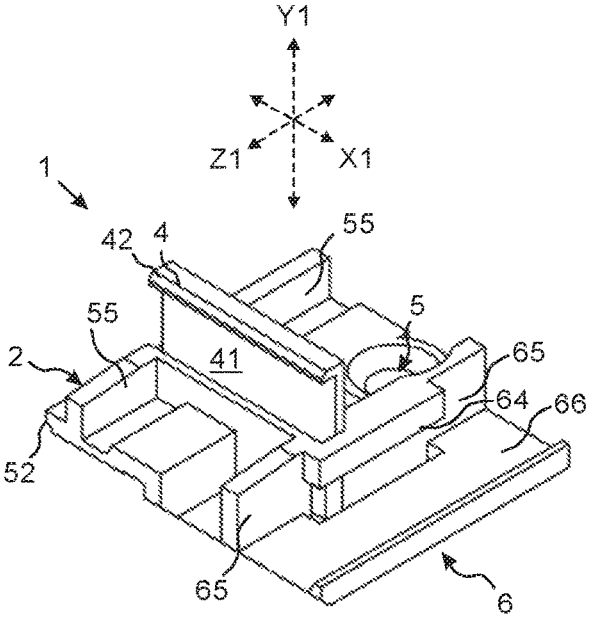
Figure 7C:
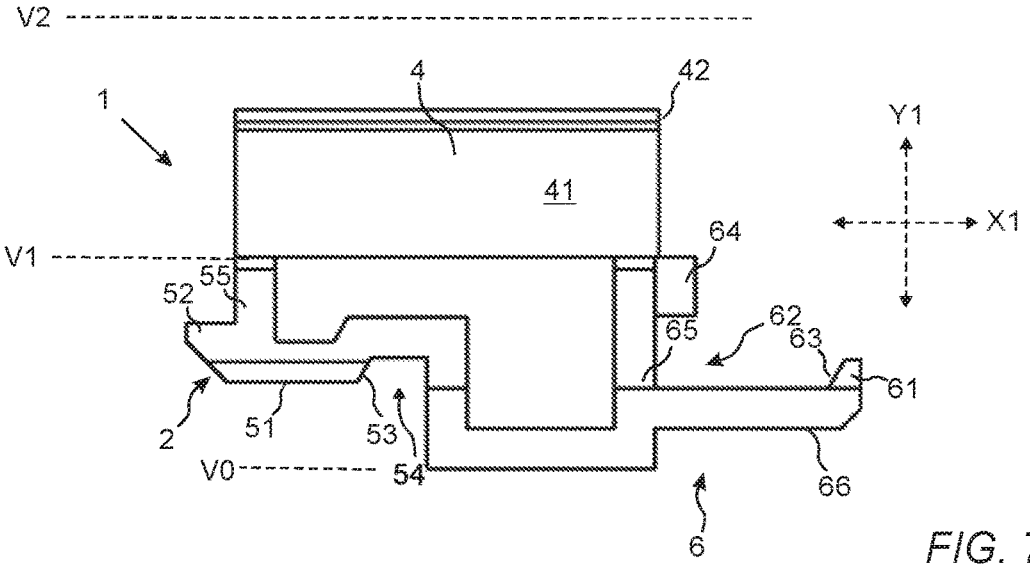
FIG. 7C shows a side view of the coupling element of FIGS. 7A-B.

A first primary coupling portion 2 and a second primary coupling portion 6 may constitute two opposite edges of the coupling element 1 as derivable from FIGS. 7A-7C. The first primary coupling portion 2 may comprise a locking edge 55 configured to extend along the primary axis Z1 and the tertiary axis Y1. The locking edge 55 may extend with a right-angle from the locking tongue 52, i.e. form a right-angle with the locking tongue 52. The locking edge may extend in a direction opposite the locking element 51 of the first primary coupling portion 2.

The locking edge 55 may be configured to abut a portion of the first edge 11 of the first building element 10 such as to prevent rotation of the coupling element 1 about an axis parallel the tertiary axis Y1 when the first building element 10 is configured in assembled state. The locking edge 55 and the edge portion of the first edge 11 may extend in parallel to form a plane extending in a direction along the primary axis Z1 and the tertiary axis Y1.

The locking edge 55 may be configured to abut a portion of the first edge 11 of the first building element 10 such as to prevent displacement of the coupling element 1 in a direction along the secondary axis X1 towards the first building element 10, when the first building element 10 is configured in assembled state.

The tongue groove 62 of the second secondary coupling portion 6 may be formed by a further locking edge 65 disposed between a protrusion 64 and a locking strip 66. The protrusion 64 may facilitate locking the coupling element 1 in a position where a proximal surface of the body 5 is arranged substantially flush with the proximal surface 15 as illustrated in FIG. 2D. The locking strip may extend from the locking edge 65 in a direction along the secondary axis X1 in engaged state and in a direction being opposite the direction in which the locking tongue 52 extends. The protrusion 64 and the locking strip 66 may extend from opposite sides, preferably opposite sides seen along the secondary axis Y1, of the further locking edge 65 in a direction along the secondary axis X1. The locking element 61 of the second primary coupling portion 6 may be provided at an end-portion of the locking strip 66. The locking element 61 may extend from the locking strip 66 in a direction along the tertiary axis Y1 in engaged state.

The locking element 61 may comprise a locking surface 63 configured to cooperate with a locking surface 122 of the second edge 12 of the first building element 10 for locking the coupling element 1 and the first building element 10 from separating in a direction transverse the second edge 12, such as along the secondary axis X1 in engaged state.

The further locking edge 65 may extend along the primary axis Z1 and the tertiary axis Y1.

The locking edge 65 may be configured to abut a portion of the second edge 12 of the first building element 10 such as to prevent rotation of the coupling element 1 about an axis parallel the tertiary axis Y1 when the first building element 10 is configured in assembled state.

The locking edge 65 may be configured to abut a portion of the second edge 12 of the first building element 10 such as to prevent displacement of the coupling element 1 in a direction along the secondary axis X1 towards the first building element 10, when the first building element is configured in assembled state.

In assembled state, the locking edges 55, 65 of the coupling element 1, may extend in a direction along the tertiary axis Y1 and the locking edge 55 may, for example, extend from the locking tongue 52 towards the secondary plane V2 to be arranged at least flush with the proximal surface 25 of the first panel 20 and/or the primary plane V1, as shown for instance in FIG. 2D. Thereby, when the first panel 20 and/or a second panel 20' is arranged in abutment with at least one of the locking edges 55, 65, the first panel 20 and/or second panel 20' may be biased outwards away from the coupling element 1 in a direction along the tertiary axis Y1 by the locking edges 55, 65 and biased inwards towards the coupling element 1 by the secondary coupling portion 4, in assembled state of the first panel 20 and optionally the second panel 20'. Thus, the locking edges 55, 65 and the secondary coupling portion 4 may facilitate proper positioning of e.g. the first panel 20 in directions along the tertiary axis Y1.

This configuration may provide for an improved engagement between the secondary coupling portion 4 and the first panel 20 because the biasing may result in tensioning of the secondary coupling portion 4, in particular the second portion 42 of the secondary coupling portion 4.

In addition, thanks to the configuration of the locking edges 55, 65 as explained above, the coupling element 1 may be arranged as a spacer interspaced between a substrate 45, such as a building stud, and a first panel 20 absent a first building element 10 for providing a spacer between the stud and the first panel 20 and/or for locking the first edge 21 of the first panel 20 in a direction transverse the substrate, such as along the tertiary axis Y1.

Referring to FIG. 2A, the first edge 11 of the first building element 10 comprises a tongue groove 111 which opens in a direction parallel the proximal surface 15 of the first building element 10 which may be in a direction along the secondary axis X1 and transverse the first edge 11 and/or transverse the longitudinal extension of the first building element 10. The tongue groove 111 is configured to receive the locking tongue 52 of the first primary coupling portion 2 by means of a folding displacement of the coupling element 1 about the primary axis Z1, for locking the coupling element 1 and the first building element 10 in a direction along the tertiary axis Y1.

The locking element 51 may comprise the locking tongue 52 and a locking surface 53. In response to the folding displacement of the coupling element 1 about the primary axis Z1, the locking surface 53 is displaced to be positioned to cooperate with the locking surface 112 of the locking element 110 of the first edge of the first building element 10 for locking of the coupling element 1 and the first building element 10 in a direction along the secondary axis X1, in particular in a direction away from each other.

Referring to FIG. 2B the second primary coupling portion 6 comprises a tongue groove 62 which opens in a direction parallel the proximal surface 15 of the first building element 10 in engaged position of the coupling element, which may be in a direction along the secondary axis X1 and transverse the first edge 11 and/or transverse the longitudinal extension of the first building element 10. The tongue groove 62 is configured to receive a locking tongue 121 of the second edge 12 of the first building element 10 by means of a folding displacement of the coupling element 1 about the primary axis Z1, for locking the coupling element 1 and the first building element 10 in a direction along the tertiary axis Y1.

The locking element 120 may comprise the locking tongue 121 on one side and a locking surface 122 on an opposite side of the locking element 120. In response to the folding displacement of the coupling element 1 about the primary axis Z1, the locking surface 63 of the locking strip 66 of the second coupling portion 6 is displaced to be positioned to cooperate with the locking surface 122 of the locking element 120 of the second edge of the first building element 10 for locking of the coupling element 1 and the first building element 10 in a direction along the secondary axis X1, in particular in a direction away from each other.

The first edge 21 of the first panel 20 may constitute an upper edge of the first panel 20 in assembled state of the first panel 20, as illustrated in FIG. 1.

The second edge 22 of the first panel 20 may constitute a lower edge of the first panel 20 in assembled state of the first panel 20.

Figure 3:
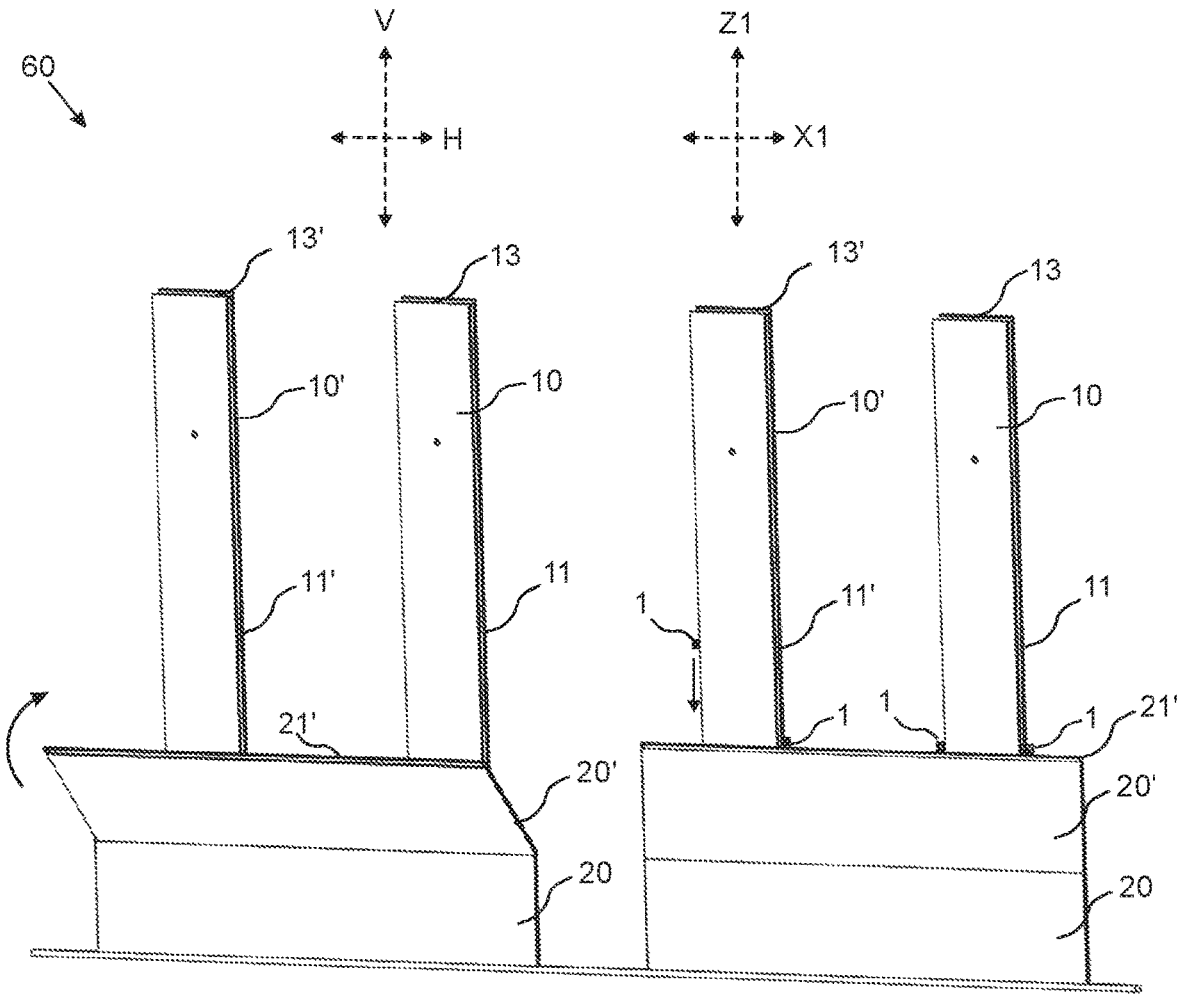
FIG. 3 is a perspective view of embodiments of the inventive concept.

The first edge 11 of the first building element 10 may constitute a right-hand edge of the first building element 10 in assembled state of the first building element 10 as illustrated e.g. in FIGS. 1, 3 and 4. However, other configurations are possible within the scope of the invention, such as left-hand edge.

The second edge 12 of the first building element 10 may constitute a left-hand edge of the first building element 10 in assembled state of the first building element 10 as illustrated in FIGS. 1, 3 and 4. However, other configurations are possible within the scope of the invention, such as right-hand edge.

The building elements of the set 60, such as the first building element 10 and the first panel 20 and second panel 20', which may be identical panels in terms of the shape thereof, may be provided with a mechanical locking system 70 for locking two similar building elements, such as the first building element 10 and the first panel 20, in a plane, such as a horizontal plane H and/or a vertical plane V. Thus, the first building element 10 and the first panel may comprise identical locking systems and/or compatible locking systems for locking of one or more similar building elements by means of direct engagement. These embodiments are generally enabled throughout the scope of the disclosure.

It has been contemplated that the first building element 10 may comprise a first mechanical locking system 70 and the first panel 20 comprises a second mechanical locking system 70' for locking two similar first panels 20, 20', preferably by means of a folding displacement, such as about the second edge 22' of the second panel 20 and/or about the secondary X1 as shown in FIGS. 3 and 5B. It is preferable that the coupling element 1 is configured to engage with the first locking system 70 of the first building element 10 and the second locking system 70' of the first panel 20.

It is further preferable that the first and second panels 20, 20' are provided with a locking system 70' for locking a panel of similar or identical shape to the first panel 20 in order to assemble the wall 59.

In one embodiment, first building element 10, the first and second panels 20, 20' comprise the same and/or identical and/or compatible locking systems such that the first building element 10 is interchangeable with the first panel 20. It is thereby achieved that the first building element 10 and first panel 20 may be manufactured by substantially the same or the same manufacturing steps, for example profiling by means of cutting, and that the wall 59 may be erected using a single type of building element, such as a building panel.

As mentioned, the panels, such as the first building element 10 and the first panels 20 may have a respective proximal surface 15, 25 and distal surface 16, 26. The proximal surface may be a top or front surface. The proximal surface may be a surface intended to be visible when the panel is configured as part of a wall or floor. The proximal surface may be a decorative surface and may comprise a decorative layer, such as a veneer layer intended to be visible.

The distal surface 16, 26 may be a back surface. The back surface may be a surface which is not intended to be visible when the panel is configured as part of a wall or floor. The back surface may comprise a balancing layer to account for movements in the proximal surface 15, 25.

The proximal surface 15 of the first building element 10 may be arranged in the primary plane V1 in assembled state, such as when the first building element 10 is engaged with the primary coupling portion 2, 6 of the coupling element 1, as shown for instance in FIGS. 5A-5B.

The proximal surface 25 of the first panel 20 may be arranged in the secondary plane V2 in assembled state, such as when the first panel 20 is engaged with the secondary coupling portion 4 of the coupling element 1, as shown for instance in FIGS. 5A-5B.

The panels 10, 20 may comprise a core made of any suitable material, such as wood, MDF, HDF, foam, wood, polymers, thermoplastic, thermosetting, PVC or any suitable material. Preferably, the core is made of a material suitable for machining, such as cutting, for example by means of rotating tools. The first and/or second mechanical locking system 70, 70' may be formed in the core of the building element, for example by means of cutting with rotating tools which are substantially stationary while the building elements are conveyed passed the rotating tool to thereby form at least part of the mechanical locking system in one or more of the edges 11, 12, 21, 22 of the building elements.

The building elements of the set 60, such as the first building element 10 and/or the first panel 20, may each have an extension in a longitudinal direction L, such as the longest side or long side, and in a transverse direction T, such as the shortest side or short side, as illustrated in FIG. 1. Further, the panels may each have thickness extension in the thickness direction D as illustrated in FIG. 2B. In assembled state of the first building element 10 and the first panels 20, the thickness of the respective elements 10, 20 may extend in along a tertiary axis Y1 as derivable from FIG. 4.

The first mechanical locking system 70 of the first building element 10 and/or the second mechanical locking system 70' of the first panel 20 may comprise edges for locking of one or more similar panels, such as the first building panel 20 and a second panel 20', in the plane of the proximal surface 15, 25, 25' and/or the distal surface 16, 26, 26' in order to keep the first and second panels 20, 20' from separating in a direction transverse the edges comprising the mechanical locking system 70, 70'.

In the exemplary embodiment of FIGS. 1, 3 and 4A-4B, a first edge 11 of the first building element 10 may constitute an edge extending in the longitudinal direction of the first building element 10, which may be parallel a primary axis Z1 in assembled state of the first building element. Generally, the term "edge" as used herein may be an outer edge of a panel, such as the first 10 and/or the first panel 20.

A second edge 12 of the first building element 10 may constitute an edge opposite the first edge 11 and extending in the longitudinal direction of the first building element 10, which may be parallel a primary axis Z1 in assembled state of the first building element 10.

In the exemplary embodiments of FIGS. 1, 3 and 4A-4B, a first edge 21 of the first panel 20 may constitute an edge extending in the longitudinal direction of the first panel 20.

A first edge 21 of the first panel 20 may constitute an edge opposite the first edge 21 and extending in the longitudinal direction of the first panel 20.

In the exemplary embodiments of FIGS. 1, 3 and 4A-4B, the first edge 21 and second edge 22 of the first panel 20 are arranged transverse the primary axis Z1 in assembled state of the first panel 20, however, other configurations are possible within the scope of the inventive concept. For example, the first 21 and second edge 22 may extend with about a 45-degree angle relative the primary axis Z1, such as if the first panels 20, 20' are assembled in a fishbone pattern.

The first edge 11 of the first building element 10 may be configured to cooperate with an edge of the first panel 20, such as the second edge 22 of the first panel 20 for locking the first building element 10 and first panel 20 in a plane, such a plane of the primary axis Z1 and the secondary axis X1, which may be a vertical plane.

The first edge 11 of the first building element 10 may be configured to cooperate with the second edge 12' of a second building element 10' for horizontal and vertical locking of the first building element 10 and the second building element 10' in a plane, such a plane of the primary axis Z1 and the secondary axis X1, which may be a vertical plane.

The second edge 12 of the first building element 10 may be configured to cooperate with the first edge 11' of a second building element 10' for horizontal and vertical locking of the first building element 10 and the second building element 10' in a plane, such a plane of the primary axis Z1 and the secondary axis X1, which may be a vertical plane. Correspondingly, the second edge 12 of the first building element 10 may be configured to cooperate with an edge of the first panel 20, such as the first edge 21 of the first panel 20 for horizontal and vertical locking the first building element 10 and the first panel 20 in a plane, such as a plane of the primary axis Z1 and the secondary axis X1, which may be a vertical plane V.

The first edge 21 of the first building panel 20 may be configured to cooperate with the second edge 22' of a second building panel 20' for horizontal and vertical locking of the first building panel 20 and the second building panel 20' in a plane, such a plane of the primary axis Z1 and the secondary axis X1, which may be a vertical plane.

The coupling element 1 may be configured to cooperate with an edge, such as a first edge 11, a second edge 12, a third edge 13, a fourth edge 14 of the first building element and/or a first edge 21, a second edge 22, a third edge 23, a fourth edge 24 of the first panel 20 of the set 60. The respective edges 11, 12, 13, 14, 21, 22, 23, 24 may be disposed between the respective proximal surface 15, 25 and the respective distal surface 16, 26 of the first element 10 and first panel 20. The edge 11, 12, 13, 14, 21, 22, 23, 24 may extend between the respective proximal surface 15, 25 and the respective distal surface 16, 26 of the first element 10 and first panel 20. The edge 11, 12, 13, 14, 21, 22, 23, 24 may extend along the tertiary axis Y1 between the respective proximal surface 15, 25 and the respective distal surface 16, 26 of the first element 10 and first panel 20 in the assembled state of the respective first element 10 and first panel 20.

One or more coupling portions of the coupling element 1 may comprise a shape or edge profile corresponding to one or more of the edges 11, 12, 13, 14, 21, 22, 23, 24 of a panel, such as the first 10 and/or first panel 20.

The coupling element 1 may be made of any suitable material such as metal, composite, preferably plastic, for example polymer-based material, polyacrylate, polyamide, POM, PP, a thermosetting material or thermoplastic material, vinyl, PVC or the like. The coupling element 1 may be rigid yet resilient. The coupling element may be resilient yet flexible. In particular, the secondary coupling portion 4, in particular the second portion 42, is preferably configured to lock the first panel 20 from folding, such as prior the assembling of second panel 20' and preferably during assembling of the second panel 20'. This configuration facilitates ease of assembling of the first and second panels to the first building element.

The coupling element may be manufactured by means of any suitable process, for example injection moulding.

The coupling element may be formed as a single entity, i.e. an element.

The coupling element 1 may comprise one or more coupling portions corresponding to one or more of the edges 11, 12, 13, 14, 21, 22, 23, 24 of the building panels such as the first building element 10 and/or the first building panel 20. This entails that the coupling element 1 may lock to a building panel, such as the first building element 10, in a plane, such as the primary plane V1 and be locked in a direction transverse the applicable edge of the panel, preferably in a direction away from the panel. In other words, this entails that the coupling element 1 may engage with an edge 11, 12, 13, 14, 21, 22, 23, 24 of a building panel, such as the first building element 10, and be locked from displacing in at least one direction, such as along the tertiary axis Y1 and preferably the secondary axis X1.

FIGS. 2B and 2C show detailed top views of the embodiment of FIG. 1. In particular, FIG. 2B shows the first coupling element 1 in engagement with the first edge of the first building element 10. FIG. 2C shows a second coupling element 1 in an engaged state with the second edge 12 of the first building element 10. The first coupling element 1 and the second coupling element 1 may be identical.

As shown in FIG. 3 the same configuration may be applied to a second building element 10'.

It should be appreciated that it may not be necessary to assemble one coupling element on each of the first and second edge 11, 12 to assemble a building panel 20, as shown in FIG. 3. It may suffice to assemble a single coupling element 1 to the first building element 10 in order to then assemble the first building panel 20 to the first building element 10. However, by providing one coupling element on each of the first and second edges 11, 12 to assemble the first panel 20, a stronger coupling is provided between the first building element 10 and the first panel 20.

Figure 8A:
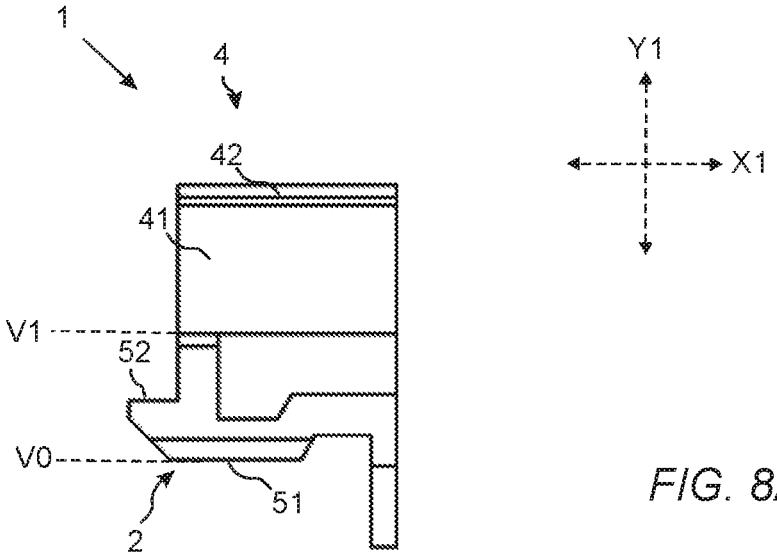
FIG. 8A is a top view of a coupling element according to an embodiment.
Figure 8B:
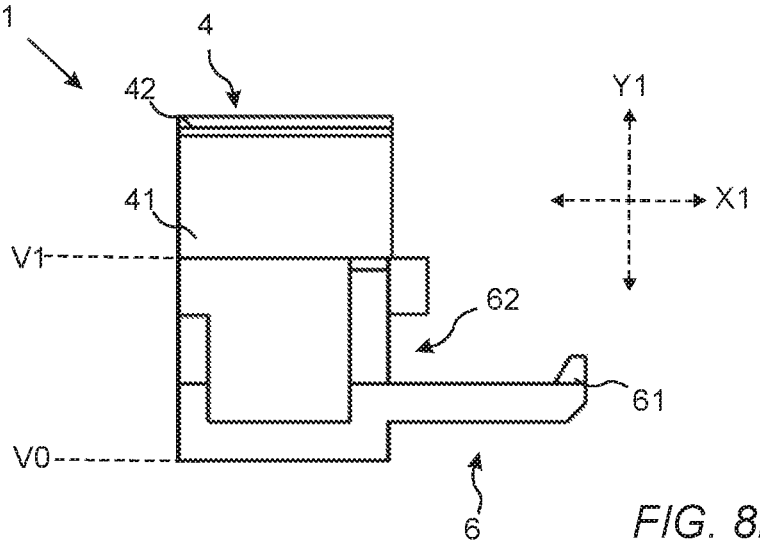
FIG. 8B is a top view of a coupling element according to an embodiment.

As shown in FIGS. 2C-2D, the coupling element 1 may comprise one or more primary coupling portions 2, 6 configured to establish locking engagement to a panel, such as the first building element 10. Alternatively, the coupling element may comprise one primary coupling portion 2, 6 as shown in FIGS. 8A-B.

In the embodiment shown in FIGS. 2C and 2D, the coupling element 1 comprises the first primary coupling portion 2 configured to engage with the first edge 11 of the first building element 10. As derivable from FIG. 2B, the first primary coupling portion 2 may comprise an edge profile corresponding to the second edge 12 of the first building element 10 shown in FIG. 2D, hence the first primary coupling portion 2 may comprise a similar edge profile.

Correspondingly, the second primary coupling portion 6 may comprise an edge profile corresponding to the first edge 11 of the first building element 10 shown in FIG. 2C.

The first primary coupling portion 2 may comprise a locking element 51 and tongue 52 as shown in FIGS. 2C and 2D.

The locking element 51 of the first primary coupling portion 2 may cooperate with the locking element 110 of the first edge 11 of first building element 10 as shown in FIG. 2C. As derivable from FIG. 2A, the locking elements 51 and 110 may extend in substantially opposite directions to facilitate locking of the coupling element 1 along the secondary axis X1. Also, the locking elements 51 and 110 may extend in a direction along the tertiary axis Y1 in assembled state of the first building element 10.

Referring again to FIG. 2C, the first edge 11 may comprise a tongue groove 111 for receiving a locking tongue 52 of the first primary coupling portion 2 of the coupling element 1. Further, the first edge 11 may comprise a locking element 110 which is configured to engage with locking element 51 of the primary coupling portion, and thus facilitates locking of the coupling element 1 in a direction along the secondary axis X1. In particular, the locking element 110 of the first edge 11 may comprise a locking surface 112 configured to cooperate with a locking surface 53 of the locking element 51 of the first primary coupling portion 2. This may correspond to locking in a plane, such as the primary plane V1, in a direction transverse the first edge 11 and away from the first edge 11.

Thanks to the locking tongue 52 and tongue groove 111, displacement of the coupling element 1 in a direction along the tertiary axis Y1 is locked, such as in a direction normal the proximal surface 15. This may include directions transverse the first primary plane V1.

The tongue groove 111 of the first edge 11 of the first building element 10 may be arranged inboard of the locking element 110 of the first building element 10 as shown in FIG. 2A.

Figure 4A:
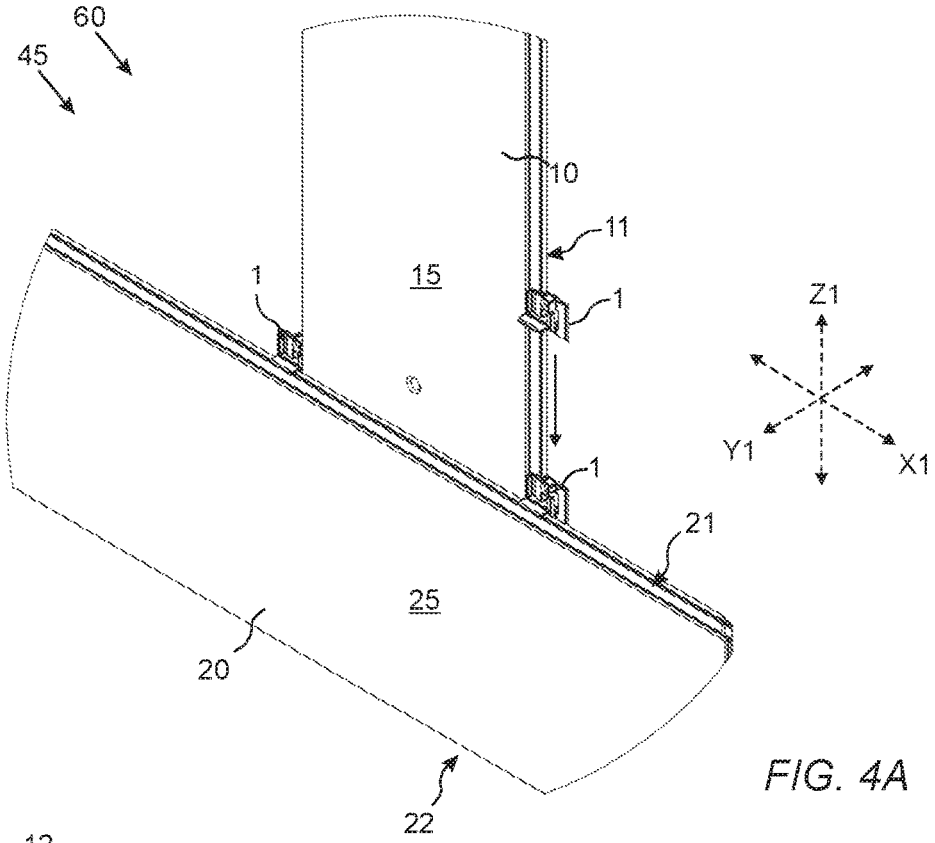
FIGS. 4A-4B are perspective views of details of the set of FIGS. 1 and 3.
Figure 4B:
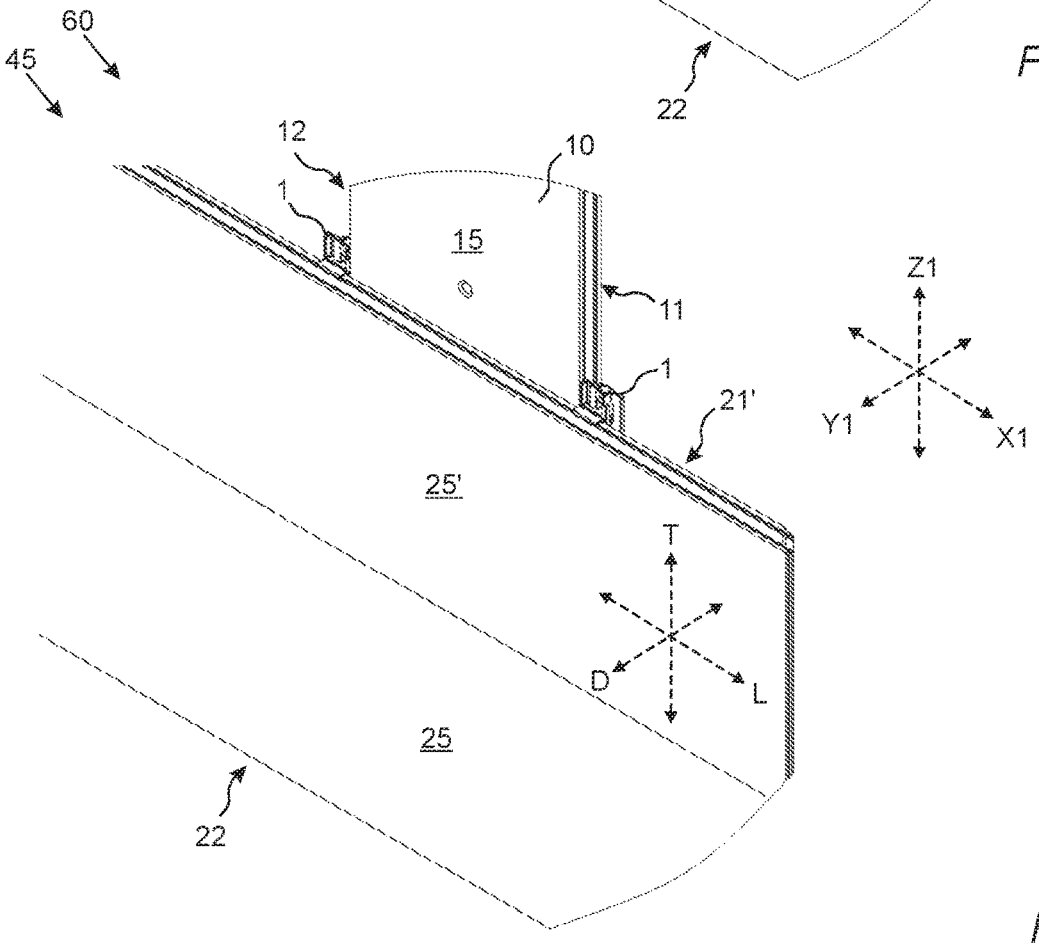

The first edge 11 of the first building element 10 may be formed to at least partially envelope the first primary coupling portion 2 of the coupling element 1, as shown in FIG. 4A.

The locking element 110 of the first edge 11 may extend in a direction substantially transverse or transverse the proximal surface 15, such as in the direction of the normal of the proximal surface 15 of the first building element 10.

Shown in FIG. 2C is a first pair of locking surfaces; first locking surface 53 and second locking surface 112 configured to engage with each other for locking of the coupling element 1 in a direction along the secondary axis X1, X1' when the coupling element 1 is engaged to the first edge 11 of the first building element 10 by means of the first primary coupling portion 2.

A first locking surface 53 extending substantially in a direction along the tertiary axis Y1 is provided by the locking element 51 of the first primary coupling portion 2.

A second locking surface 112 extending substantially in a direction along the tertiary axis Y1 when the first building element 10 is in assembled state, is provided by the locking element 110 of the first edge 11 of the first building element 10.

Shown in FIG. 2D is a second pair of locking surfaces; third locking surface 63 and fourth locking surface 122 configured to engage with each other for locking of the coupling element 1 in a direction along the secondary axis X1, X1' when the coupling element 1 is engaged to the second edge 12 of the first building element 10 by means of the second primary coupling portion 6. The third locking surface 63 is provided on a locking element 61 extending in a direction transverse the locking element 120 of the second edge 12 of the first building element 10. The locking element 61 extends along the tertiary axis Y1 and is provided on a locking strip 66 extending in along the secondary axis X1. Thereby the locking strip 66 and the locking element 61 forms a groove which opens in a direction along the tertiary axis Y1 and is configured to receive the locking element 120 for locking the coupling element 1 and the first building element 10 in a direction along the secondary axis X1 and in directions away from each other.

The third locking surface 63 extending substantially in a direction along the tertiary axis Y1 is provided by the locking element 61 of the second primary coupling portion 6. The fourth locking surface 122 extending substantially in a direction along the tertiary axis Y1 when the first building element 10 is in assembled state, is provided by the locking element 120 of the second edge 12 of the first building element 10.

The locking element 61 of the second primary coupling portion 6 may cooperate with the locking element 120 of the second edge 12 of first building element 10. As derivable from FIG. 2B, the locking elements 61 and 120 may extend in substantially opposite directions to facilitate locking along the secondary axis X1. Also, the locking elements 61 and 120 may extend in a direction along the tertiary axis Y1 in assembled state of the first building element 10.

The second primary coupling portion 6 may be formed to at least partially envelope the locking element 120 of the second edge 12, as shown in FIG. 2A.

The locking elements 51, 61 and 110, 120 may be disposed between the proximal surface 15 and the distal surface 16 in assembled state of the first building element 10, as shown in FIGS. 2A-2B.

The second edge 12 of the first building element 10 may comprise a locking tongue 121 configured to be received in a corresponding tongue groove 62 of the second primary coupling portion 6 of the coupling element 1. The locking tongue 121 may be integrally formed with the locking element 120 of the second edge 22. Thanks to the locking tongue 121 and tongue groove 62 of the second primary coupling portion 6 of the coupling element 1, displacement of the coupling element 1 in directions transverse the first primary plane V1 is prevented. Thus, displacement of the coupling element 1 along the tertiary axis Y1 is locked, such as along the normal of the proximal surface 15.

The locking element 61 of the second primary coupling portion 6 of the coupling element 1 may be formed outboard the tongue groove 62 of the second primary coupling portion 6.

The second primary coupling portion 6 may be formed to at least partially envelope the locking element 120 of the second edge 12 of the first building element 10.

It may thereby be achieved that the coupling element 1 is locked from displacement along the secondary axis X1 and tertiary axis Y1 while being displaceable along the primary axis Z1. Typically, the first and second edges 11, 12 extend substantially along the entire, or along the entire longitudinal L length of the element 10.

This configuration facilitates that the coupling element 1 may be configured in an engaged state with the first building element 10 some distance apart from the first panel 20, and then displaced along the primary axis Z1 to the extent that the secondary coupling portion 4 engages with an edge, such as the first edge 21 of the first panel 20, to thereby obtain an engaged state with the first panel 20 and thus the first panel 20 is configured in assembled state with the coupling element, as shown in FIGS. 3 and 4A.

As explained above, the coupling element 1 may be arranged in an engaged state where it is coupled to the mechanical locking system 70 of a panel, such as the first building element 10.

Thanks to the coupling element 1 being displaceable in a direction parallel first and second edges 11, 12 of the first building element 10 in the engaged state, the coupling element 1 may alternatively be threaded on to the first or second edge 11, 12 at the short side of the first building element 10, i.e. at the third edge 13 or fourth edge 14. Preferably, the coupling element 1 obtains the engaged state by a pivoting or folding displacement of the coupling element 1. In particular, the pivoting displacement may comprise pivoting about the primary axis Z1, Z1' for example when being parallel the first edge 11 and/or second edge 12 of the first building element 10 in assembled state, as shown in FIGS. 5A-5B. Preferably, the pivot point of the pivoting or folding is an axis Ax, Ax' extending in a direction along the primary axis Z1, Z1', preferably the respective axes Ax, Ax' are positioned between the primary coupling portion 2, 6 and the first edge 11 or the second edge 12 of the first building element 10 as schematically illustrated in FIGS. 2C-2D.

It may be appreciated that alternatively, the first building element 10 may be folded about an axis being parallel the primary axis Z1 in order for the first building element 10 to obtain an engaged state with the coupling element 1. However, typically as explained, the first building element 10 is stationary and instead the coupling element 1 folded to engage with the first building element 10.

Referring to FIGS. 5A-5C and FIGS. 6A-6B, the coupling element 1 may comprise secondary coupling portions 4,8 for engaging with a first edge 21 of a first panel 20 arranged in the secondary plane V2 in assembled state. The first secondary coupling portion 4 may comprise a first portion 41 extending in a plane transverse the primary plane V1 towards the secondary plane V2 in assembled state of the first panel 20. The first portion 41 may extend in a direction along the tertiary axis Y1.

In the following description, the first edge 21 of the first panel 20 may comprise the features as explained in relation to the first edge 11 of the first building element 10. Also, the second edge 22 of the first panel 20 may comprise the features as explained in relation to the second edge 12 of the first building element 10. Generally, the first edge 21 of the first panel 20 and the second edge 22' of the second panel 20' are locked by the corresponding features and movements as described in relation to FIGS. 2A-2D; the first edge 21 of the first panel 20 corresponding to the second primary coupling portion 6 or the first edge 11 of the first building element 10; the second edge 22' of the second panel 20' corresponding to the first primary coupling portion 2 or the second edge 12 of the first building element 10.

The first secondary coupling portion 4 may comprise a groove 43 and/or a hook-shaped profile 44 configured to receive a portion of an edge of the first panel 20, such as the first edge 21 of the first panel 20. The first edge 21 of the first panel may be identically shaped the first as the edge 11 of the first building element 10. The hook-shaped profile 44 and/or the groove 43 may comprise the first portion 41 and a second portion 42 extending in a direction along the primary axis Z1.

The second portion 42 may thereby lock the first edge 21 of the first panel 20 from displacing in a direction along the tertiary axis Y1. The second portion 42 may engage with the locking element 110' of the first edge 21 of the first panel 20, which may correspond to the locking element 110 of the first edge 11 of the first building element 10.

The second portion 42 may engage with the locking element 110' of the first edge 21 of the first panel 20, which may correspond to the locking element 110 of the first edge 11 of the first building element 10.

The first portion 41 may be configured to engage with an outermost edge surface 113' of the first panel 20 in assembled state of the coupling element 1 and the first panel 20, wherein said engaging may comprise extending along and being in abutment with the outermost edge surface 113' of the first panel 20. The outermost edge surface 113' may be disposed at a side of the locking element 110' being an opposite side of the locking surface 112'. Thereby, the tolerances of the cooperating locking surfaces 112' and 122' may not have to be adjusted to take account for the secondary coupling portion cooperating with the second locking system 70'. Thereby, the need for a certain play between the locking surfaces 112' and 122' may not be necessary to account for the second portion, and thereby certain fitting of second locking system 70' maintained. Thus, the second locking system 70' of the first panel 20 and the second panel 20' may accommodate the secondary coupling portion 4 without affecting the tolerances of the locking surfaces 112' and 122', thereby the first panel 20 and the second panel 20' may not slide away from each other in directions along the primary axis Z1 to cause a gap between the first edge 21 of the first panel 20 and the second edge 22' of the second panel 20'.

The cooperating locking surfaces 112' and 122' may be referred to as horizontal locking surfaces which cooperate for horizontal locking of the first panel 20 and the second panel 20' i.e. when assembled as a floor, to thereby lock the first edge 21 of the first panel 20 to the second edge 22' of the further second 20' in a vertical direction Z1 and away from each other when assembled as a wall.

The locking surface 122' may be provided in a locking groove 115' of the second panel 20', the locking groove 115' being configured to receive the locking element 110' of the first panel 20 to facilitate locking along the primary axis Z1 when the first edge 21 of the first panel 20 is assembled in locking position with the first edge 21' of the second panel 20'.

The second portion 42 may cooperate with an outermost edge surface 114', in a direction towards the proximal surface, of the locking element 110'.

Figure 5C:
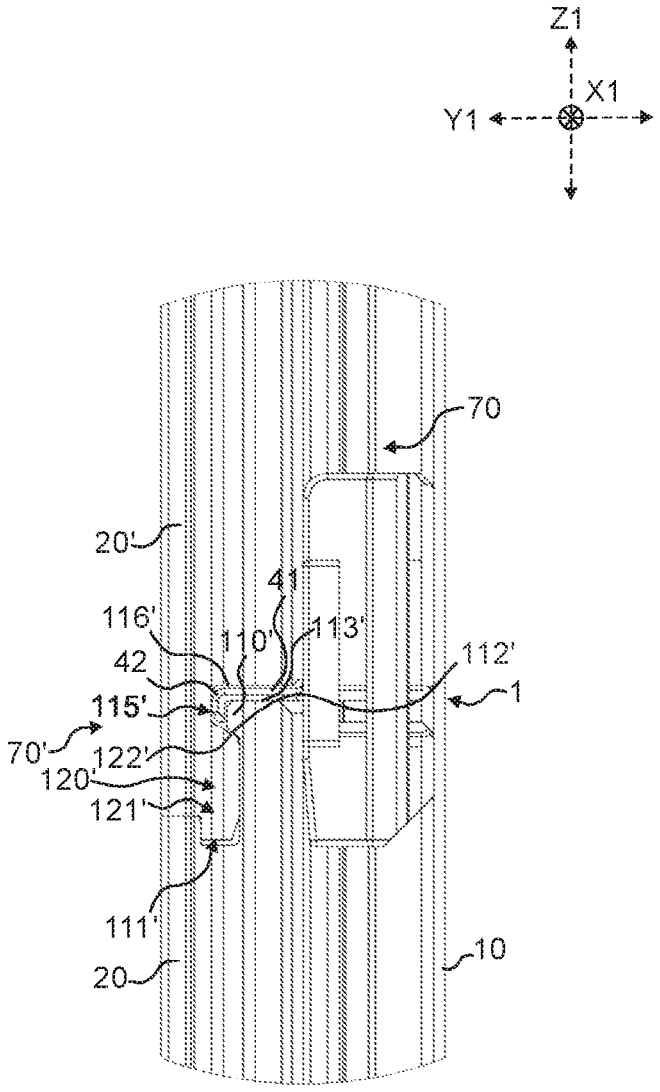
FIG. 5C is a side view of the embodiment of FIG. 5A with a second panel assembled to the first panel.

The first portion 41 may be interspaced and optionally clamped between a lower edge portion 116' of the second panel 20', which may be disposed inboard of locking tongue 121', and the outermost edge surface 113' of the first edge 21 of the first panel as shown in FIG. 5C.

The locking element 110' may be disposed between proximal surface 25 and distal surface 26 of the first panel 20 in assembled state.

The locking element 110' may be integrally formed with a locking strip 117' forming a tongue groove 111' and/or extending from the tongue groove 111'.

The second portion 42 may preferably be received in a locking groove 115' of the second panel 20'. The locking groove 115' may be configured to receive said locking element 110' for mechanical locking of the first panel 20 and the second panel 20' in a direction of the plane of the proximal surface 25, and in a direction away from each other along the primary axis Z1.

The locking element 110' may comprise a locking surface 112' configured to cooperate with a locking surface 122' of the second panel 20' for locking of the first panel 20 and the second panel 20' in a plane, and in a direction transverse the first edge 21 and away from each other.

The locking element 110' may extend from locking strip 117' and along tertiary axis Y1 in assembled state.

A fourth locking surface 122 extending substantially in a direction along the tertiary axis Y1 when the first panel 20 in assembled state, is provided by the locking element 120' of the first edge 21 of the second panel 20'.

As illustrated in FIG. 5B, the locking groove 115' opens in a direction towards the plane of distal surface 26' of the second panel 20' and is configured to receive the locking element 110' by means of a folding displacement about the secondary axis X1 of the second panel 20' as shown in FIG. 5B and FIG. 3. Also, as shown in FIG. 5B, the locking groove 115' may be configured to receive at least the second portion 42 of the secondary coupling portion, and optionally a portion of the first portion 41, by means of a folding displacement about the secondary axis X1 of the second panel 20'.

Thereby, in assembled state of the first panel 20 and the second panel 20' to each other, wherein the first panel 20 and the second panel 20' are locked to each other by means of the second mechanical locking system 70', i.e. via direct engagement with each other, the second coupling portion 4 may simultaneously be locked to the first and second panel 20, 20' by means of engaging with the locking system 70'. Thereby, the coupling element 1 is locked from displacing at least in a direction along the primary axis Z1, such as vertically V upwards and downwards, and the tertiary axis Y, such as a proximal and distal movement, and optionally also along the secondary axis X1 by means of the clamping of the second coupling portion 4 between the first edge 21 and the second edge 22'.

In assembled position, the locking groove 115' may open in a direction along the tertiary axis Y1 as shown in FIG. 5C towards the coupling element 1.

The tongue groove 111', as previously described, opens in a direction along the primary axis Z1, such as vertically V upwards. The tongue groove 111' may be configured to receive the locking tongue 121' of the second edge 22' of the second panel 20' by means of the folding about the secondary axis X1 (see FIG. 5B and FIG. 3) to thereby lock the first panel 20 and the second panel 20' in a direction along the tertiary axis Y1, such as in a proximal direction and a distal direction.

Thereby, the first panel 20 and the second panel 20' are locked horizontally and vertically by means of direct engagement between the first edge 21 of the first panel 20 and the second edge 22' of the second panel 20'.

Figure 6A:
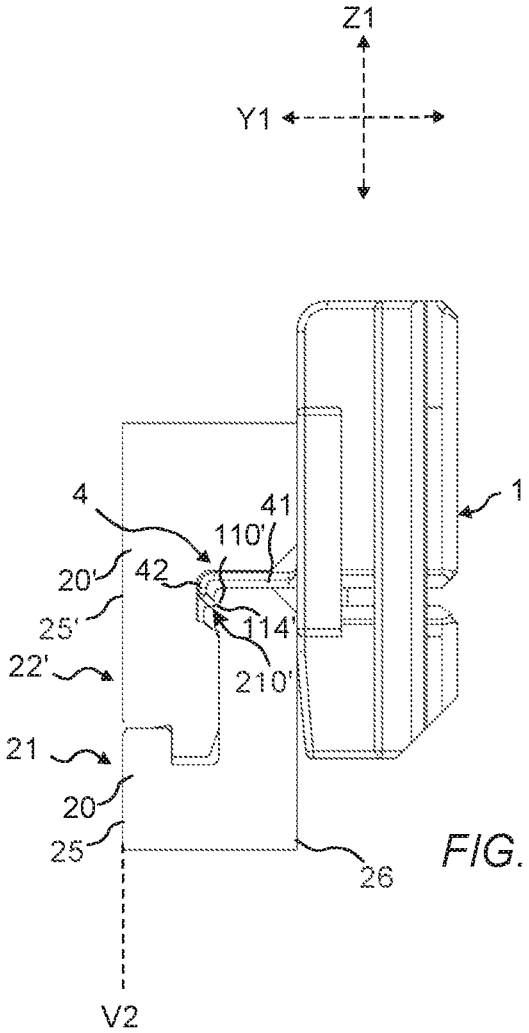
FIG. 6A shows an embodiment comprising a locking element provided with a shelf.
Figure 6B:
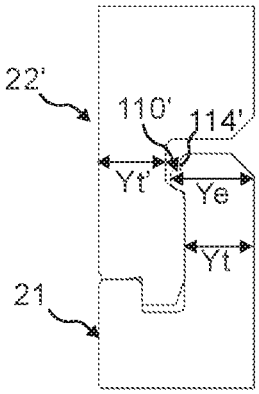
FIG. 6B shows details of the embodiment of FIG. 6A.

FIGS. 6A-6B illustrate a locking element 110' of the first edge 21 of the first panel 20 provided with a shelf 210'. The shelf 210' may preferably be provided in a portion of the locking element 110' adjacent the secondary coupling portion 4 which extends with its first portion 41 and optionally the second portion 42 optionally jammed between the first edge 21 of the first panel 20 and a second edge 22' of a second panel 20'. The shelf 210' may thus provide a void for accommodating the second portion 42 of the secondary coupling portion 4. This configuration brings about the technical advantage that the extension of the locking element 110' of the first panel 20, such as in a direction of the tertiary axis Y1, does not have to be reduced to accommodate the secondary coupling portion 4, and thus provides an improved more secure locking function. As derivable from FIGS. 6A-6B, in this embodiment the shelf 210' may comprise an outer edge surface 114' of the locking element 110', in a direction towards the proximal surface, which the second portion 42 may cooperate with.

The second portion 42 may cooperate with an outermost edge surface 114', in a direction towards the proximal surface, of the locking element 110'.

As derivable from FIGS. 6A-6B, in this embodiment the shelf 210' may comprise an outer edge surface 114' of the locking element 110', in a direction towards the proximal surface, which the second portion 42 may cooperate with.

The second portion 42 may cooperate with an outermost edge surface 114', in a direction towards the proximal surface, of the locking element 110'.

The embodiment of FIGS. 6A-6B may be combined with any embodiment of the coupling element.

The embodiment of FIGS. 6A-6B may be combined with any embodiment of the coupling element.

An alternative way of accommodating the second portion 42 of the secondary coupling portion 4 may be that the thickness Yt of the locking strip 117' of the first edge 21 of the first panel 20 adjacent the locking element 210 is reduced, and the extension Ye of the locking element 210' along the tertiary axis Y1 is reduced, to thereby provide a void for accommodating the second portion 42. However, this may have the consequence that the construction of the first edge 21 of the first panel 20 is weakened. The provision of the shelf 210' mitigates this problem since the thickness Yt or the thickness Yt' of the second edge 22' of the second panel 20' adjacent the locking groove 115' may not have to be reduced.

A further alternative way of accommodating the second portion 42 of the secondary coupling portion 4 may be that the smallest thickness Yt' of the second edge 22' of the second panel 20' may be reduced to provide a void for accommodating the second portion 42. The smallest thickness Yt' being disposed opposite and adjacent the locking element 110' in engaged state of the first panel 20 and the second panel 20' as shown in FIG. 5C. However, this may have the consequence that the construction of the second edge 22' of the second panel 20' is weakened and thus the joint between the first panel 20 and the second panel 20' may be weakened. The provision of the shelf 210' mitigates this problem since the thickness Yt' may not have to be reduced.

FIGS. 8A-8B show two exemplary embodiments of the coupling element 1 featuring single primary coupling portions; FIG. 8A showing an embodiment provided with the first primary coupling portion 2 and the secondary coupling portion 4, as described above in relation to the embodiment of FIG. 2C. FIG. 8B showing an embodiment provided with the second primary coupling portion 6 and the secondary coupling portion 4, as described above in relation to the embodiment of FIG. 2C.

Figure 9A:
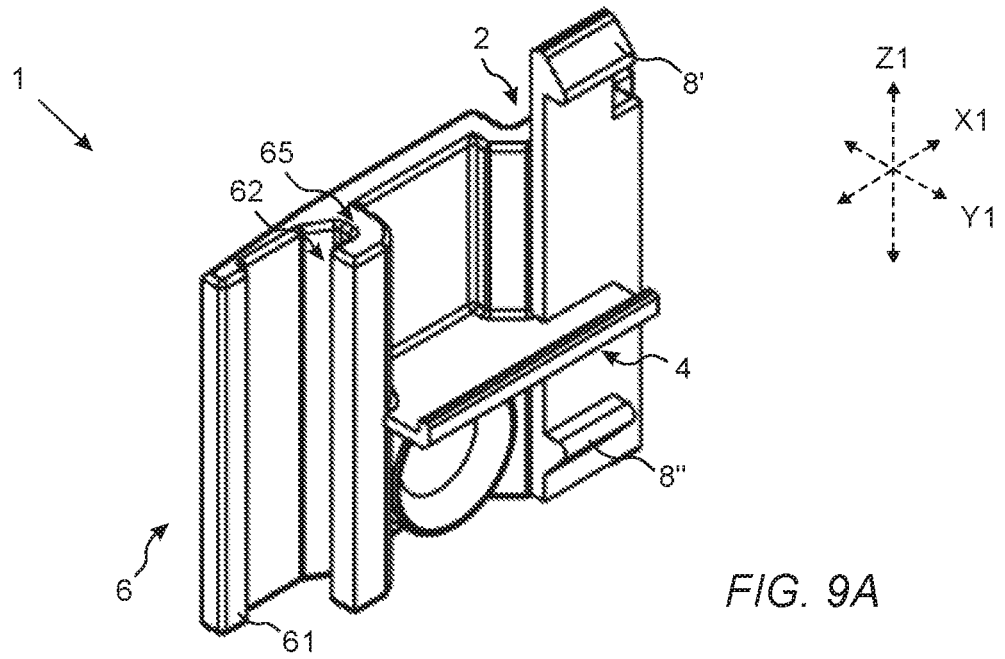
FIG. 9A is an isometric view of a coupling element according to an embodiment.
Figure 9B:
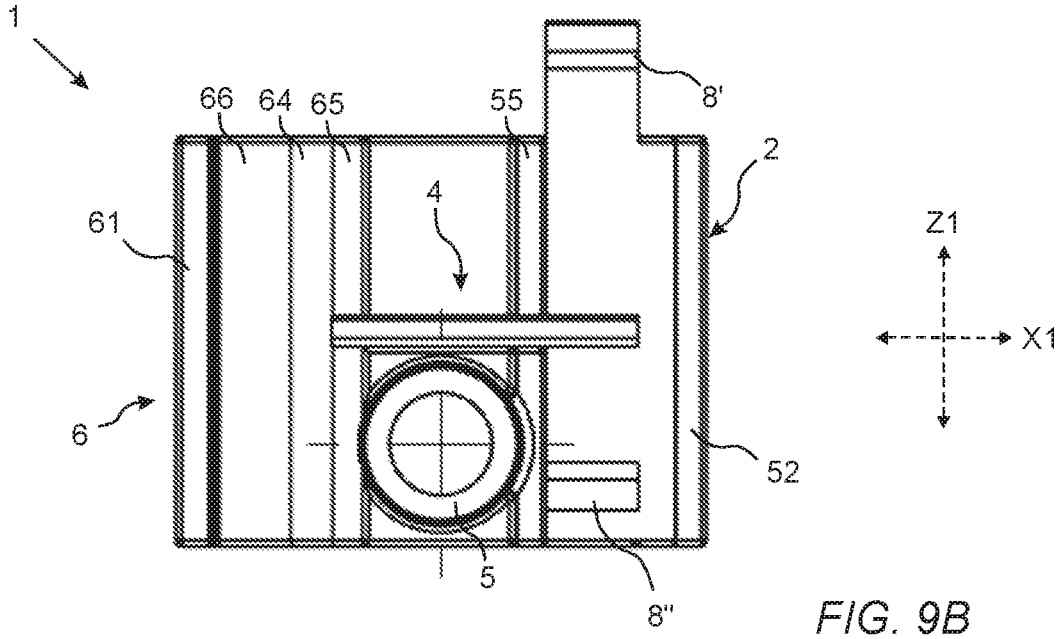
FIG. 9B is a front view of the embodiment of FIG. 9A.
Figure 11A:
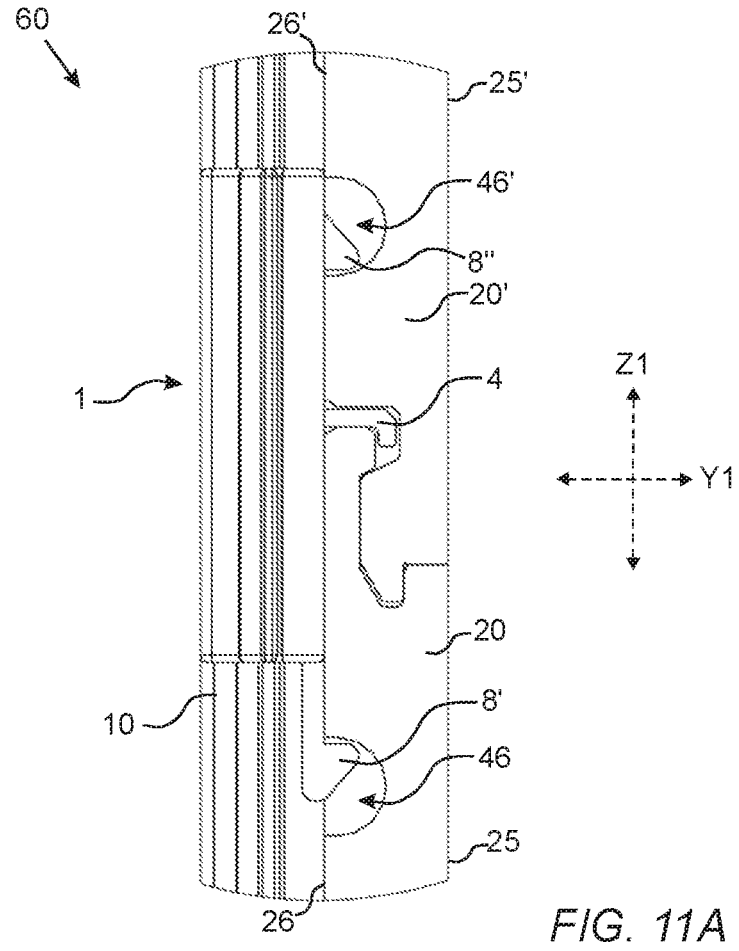
FIG. 11A is a side view of a system comprising the embodiment of FIG. 9A in assembled state.

FIGS. 9A-9B show a further exemplary embodiment of the inventive concept which in addition to the embodiment of FIGS. 2C-2D comprises further secondary coupling portion 8', 8". The further secondary coupling portion 8', 8" may comprise one or more protrusions extending in the same direction as the first secondary coupling portion 4 i.e., in a direction along the tertiary axis Y1. The protrusions may be provided on opposite sides of the secondary coupling portion 4 and be adapted to mate with or be received in longitudinally extending grooves 46, 46' (see FIG. 11A-11B)

respectively provided at the distal surface 26 of a first panel 20 and at the distal surface 26' of a second panel 20' arranged in engagement with the first edge 21 of the first panel 20, as shown in FIGS. 9A-9B and 11A.

Figure 10A:
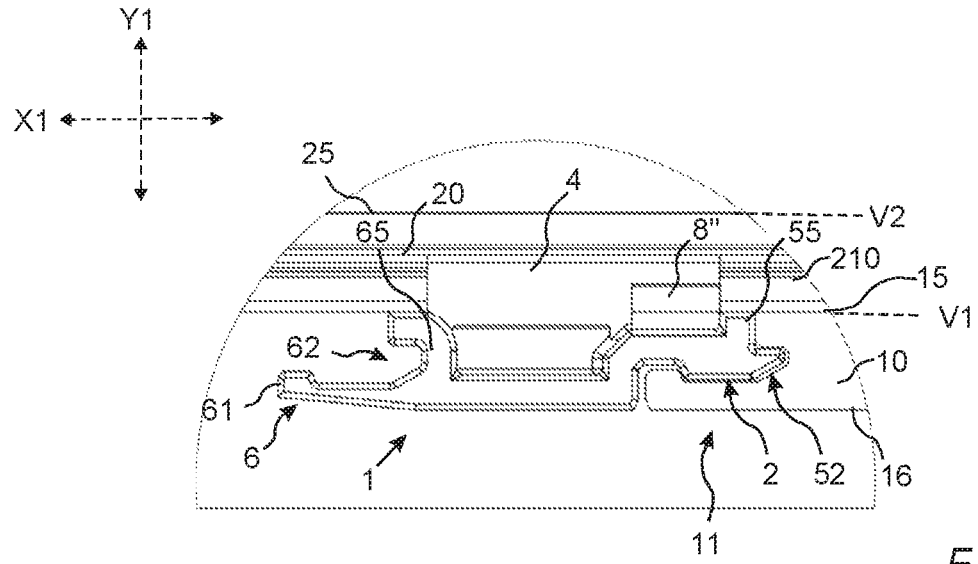
FIG. 10A is a top view of a system comprising the embodiment of FIG. 9A in assembled state.
Figure 10B:
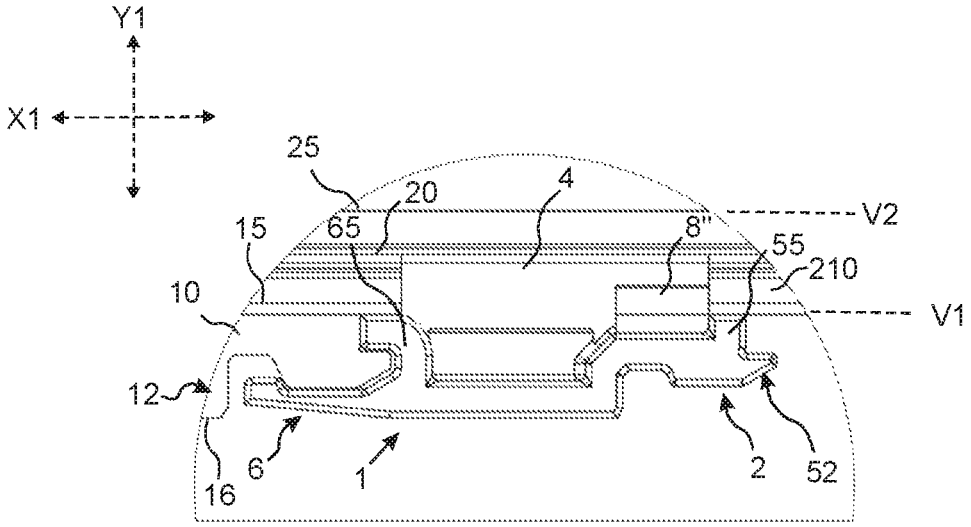
FIG. 10B is a top view of a system comprising the embodiment of FIG. 9A in assembled state.
Figure 11B:
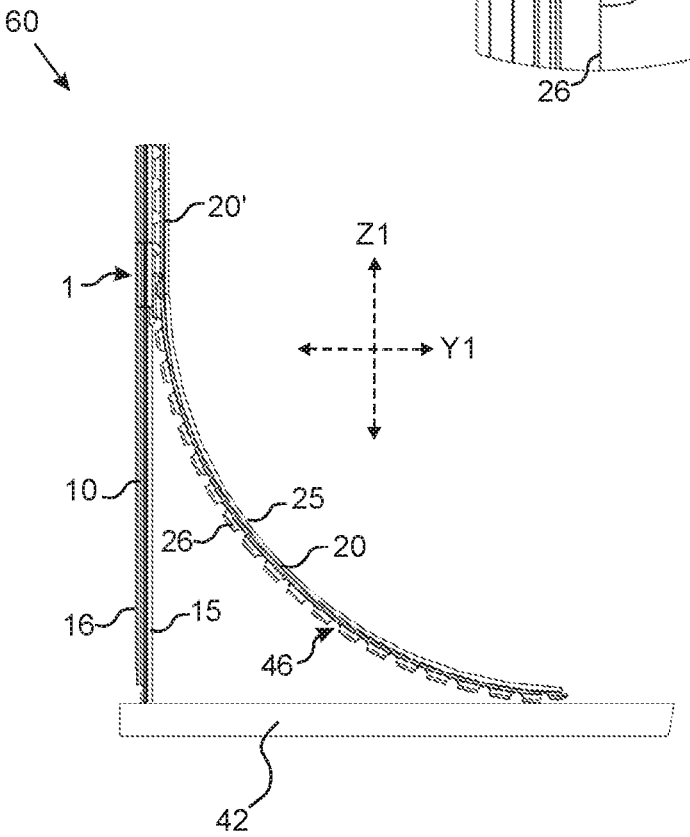
FIG. 11B is another side view of a system comprising the embodiment of FIG. 9A in assembled state.

FIG. 11A-11B shows a set comprising of embodiment shown in FIGS. 9A-9B, 10A-10B wherein a coupling element 1 is in engaged state with the first edge 11 of the first building element 10, a first panel 20 and second panel 20'.

The further secondary coupling portions 8', 8" may facilitate an improved locking function curtsey of the further coupling portions 8', 8" being received in in one or more longitudinally L extending grooves 46 provided on the distal surface 26, 26' of the first panel 20 and/or a second panel 20' facing the first building element 10.

This configuration brings about the technical effect that the coupling element 1 may follow the displacement of the first panel 20 and/or the second panel 20', such as due to thermal expansion. For example, a vertical displacement of the first panel 20 upwards in the direction of the primary axis Z1 may push the coupling element 1 upwards by exerting force on the secondary coupling portion 4.

A vertical displacement of the first panel 20 downwards in a direction of the primary axis Z1 may pull the coupling element 1 downwards by exerting a pulling force on the further secondary coupling portion 8', 8" engaging with the grooves 46 of the first panel 20.

Also, a vertical displacement upwards in the direction of the primary axis Z1 of the second panel 20' will pull the coupling element 1 upwards by exerting force on the further secondary coupling portion 8" engaging with the grooves 46' of the second panel 20'.

It should be appreciated that the configuration above may function mutatis mutandis if the first panels 20, 20' are arranged standing and the displacements are lateral instead of vertical.

FIG. 10A shows a top view of the coupling element 1 of FIG. 7 configured in engaged state with the first edge 11 of the first building element 10. As derivable from FIG. 8A, the first primary coupling portion 2 is received in a portion of the first edge 11, in particular the locking tongue 52 of the first primary coupling portion 2 is received in the tongue groove 18 of the first edge 11. Further, the locking element 51 of the first primary coupling portion 2 engage with the locking element 110 of the first edge 11 for locking displacement of the coupling element 1 in a direction along the secondary axis X1, such as away from the first edge 11.

FIG. 10B shows a top view of the coupling element 1 of FIG. 7 configured in engaged state with the second edge 12 of the first building element 10. As derivable from FIG. 10B, a portion 120, 121 of the second edge 12 of the first building element 10 is received in the second coupling portion 6, in particular the locking tongue 121 of the second edge 12 is received in the tongue groove 62 of the second edge 12. Further, the locking element 61 of the second primary coupling portion 6 engages with the locking element 120 of the second edge 12 for locking displacement of the coupling element 1 in a direction along the secondary axis X1, such as away from the second edge 12.

Figure 12:
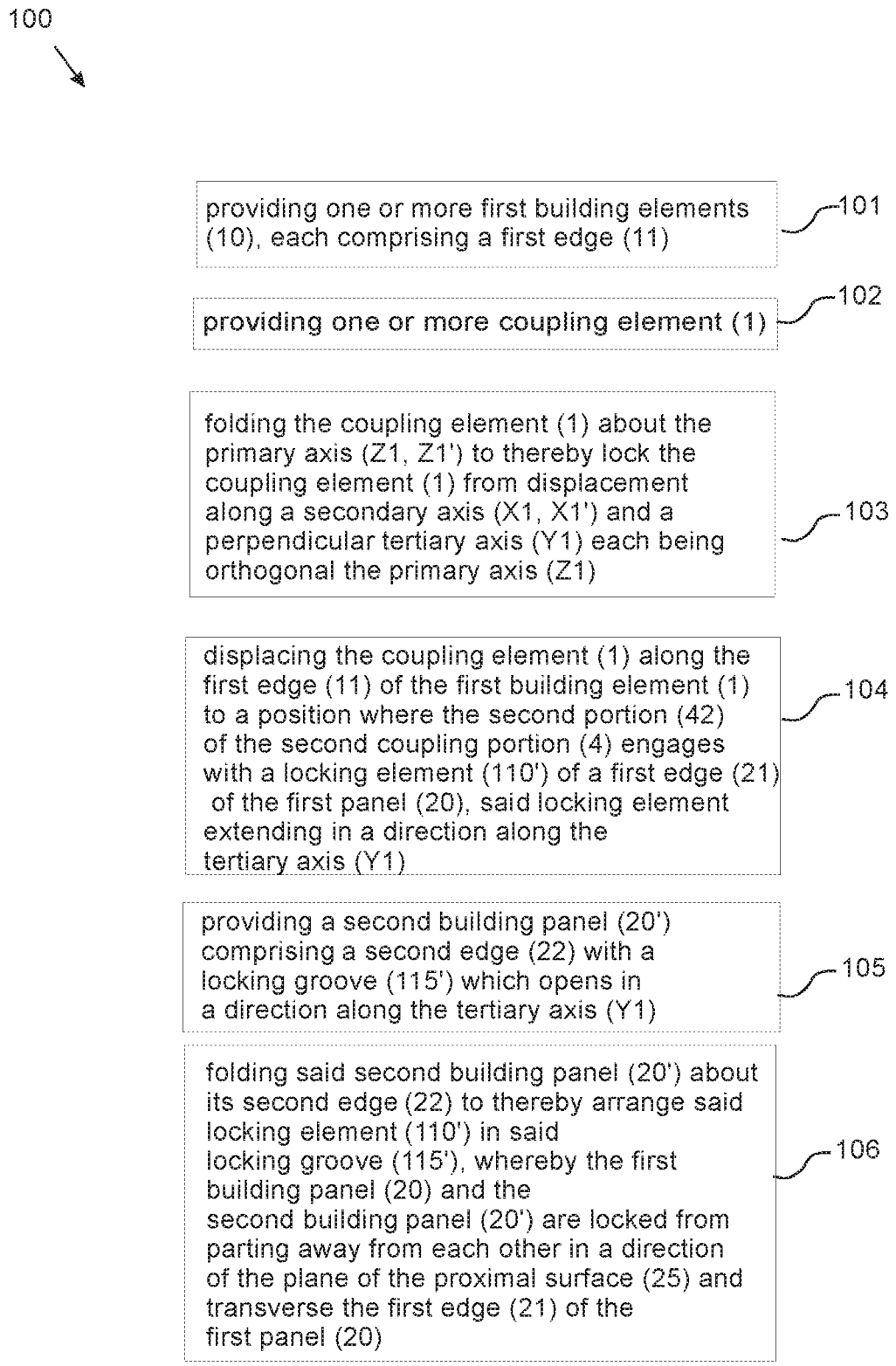
FIG. 12 is a diagrammatic representation of a method according to an embodiment.

FIG. 12 is a diagrammatic representation of a method 100 according to aspects of the inventive concept. Building elements, such as one or more building elements 10, 10', 10" and one or more building panels 20, 20' may be assembled by means of the method 100. The method 100 of assembling a first building panel and a second building panel to a first building element, may comprise:

- a step 101 of providing one or more first building elements, each comprising a first edge;
- a step 102 of providing one or more coupling element, said element comprising:
  - a primary coupling portion extending along a primary axis and being configured to cooperate with a first mechanical locking system of the first edge of the first building element to obtain an engaged state with the first edge by means of a folding displacement of the coupling element about the primary axis;
  - a secondary coupling portion comprising a first portion extending in a direction along the tertiary axis and a contiguous second portion extending in a direction along the primary axis, the secondary coupling portion configured to cooperate with a second mechanical locking system of the first panel, wherein said second mechanical locking system configured for horizontal and vertical locking with an essentially identical second panel;
- a step 103 of folding the coupling element about the primary axis to thereby lock the coupling element from displacement along a secondary axis and a perpendicular tertiary axis each being orthogonal the primary axis; and
- a step 104 of displacing the coupling element along the first edge of the first building element to a position where the second portion of the second coupling portion engages with a locking element of a first edge of the first panel, the locking element extending in a direction along the tertiary axis;
- a step 105 of providing a second building panel comprising a second edge with a locking groove which opens in a direction along the tertiary axis;
- a step 106 of folding the second building panel about or along its second edge to thereby arrange said locking element in the locking groove, whereby the first building panel and the second building panel are locked from parting away from each other in a direction of the plane of the proximal surface and transverse the first edge of the first panel.

In one embodiment, the first edge 11 of the first building element 10 may extend from a proximal surface 15 to a distal surface 16 of the first building element 10 in a direction along a tertiary axis Y1 and faces in a direction generally along a secondary axis X1, X1' towards the first coupling portion 2, 6 in engaged state, said first edge 11. The first and second edges 21, 22 of the first panel 20 may extend between respective proximal and distal surfaces 25, 26 of the first panel 20 and comprises the second locking system 70'.

In one embodiment, a second edge 22' of the second panel 20' may comprise a locking tongue 121 configured to be received in a tongue groove 111' of the first edge 21 of the first panel 20 by means of the step of folding the second panel 20' about its second edge 22' for locking of the first panel 20 and the second panel (20') in a direction transverse the proximal surface 25, 25'.

One or more of the locking elements 51, 61, 110, 120 may extend in a direction substantially along the tertiary axis Y1 when the first building element 10 and/or first panel 20 are in assembled state with the coupling element 1.

Figure 13:
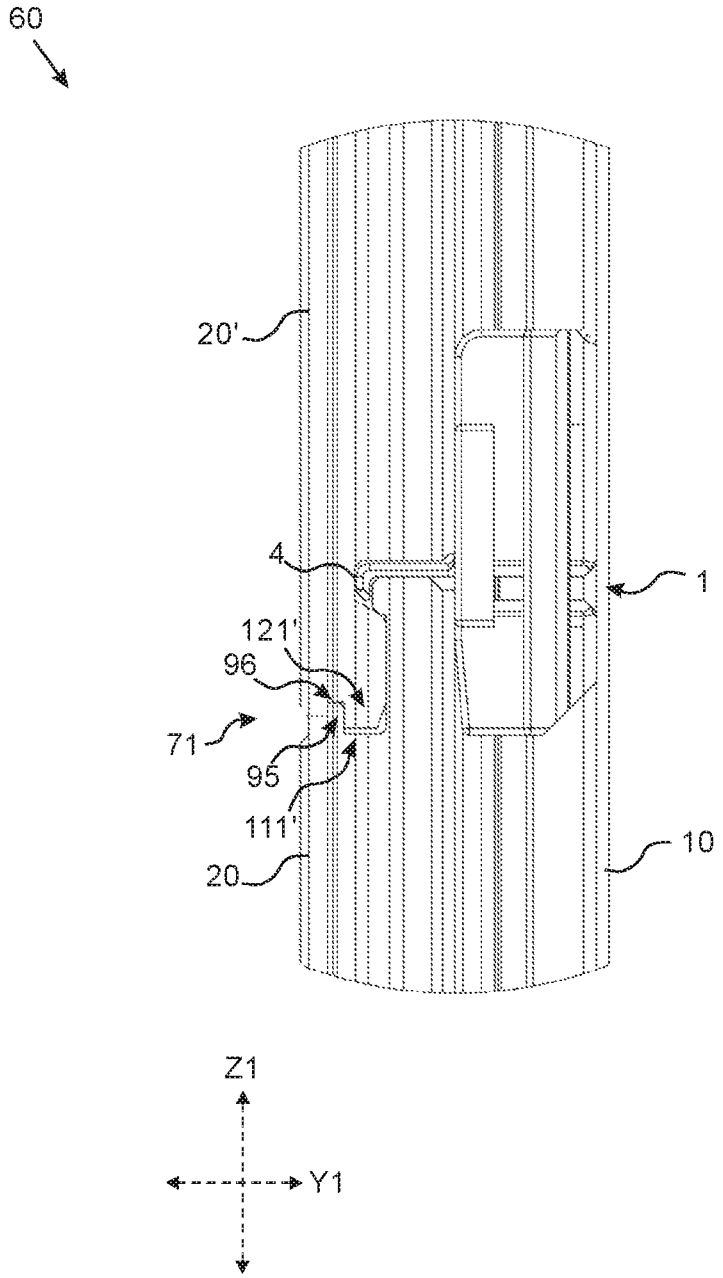
FIG. 13 shows details of a system according to an embodiment.

FIG. 13 shows an example of the secondary coupling portion 4 of the coupling element 1 cooperating with a locking system 70 of a first panel 20 and a second panel 20'. As seen from FIG. 10, the first edge 21' of the second panel 20' comprises a locking tongue 121 which is received in a tongue groove 111 of the first edge 21 of the first panel 20 for locking of the first panel 20 and the second panel 20' in a direction along the primary axis Z1. The locking of the panels 20 and 20' may involve folding of the second panel 20'. In this particular example the locking system 70 comprises a joint 71 of improved resistance to water penetration formed by the second edge 22' of the second panel 20' and the first edge 21 of the first panel 20. As derivable from FIG. 11, the joint 71 comprises a groove 96 provided between a locking element 121 and the proximal surface 26' of the second panel 20'. The groove 96 may be configured to receive a corresponding protrusion 95 provided between a tongue groove 111' of the first edge 21 of the first panel 20 for sealing engagement therewith. This embodiment may be particularly advantageous for applications in wet spaces, such as bathrooms, kitchens etc.

Figure 14A:
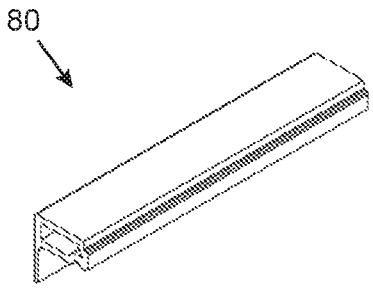
FIGS. 14A-14D show views of a ceiling mould according to an embodiment.
Figure 14B:
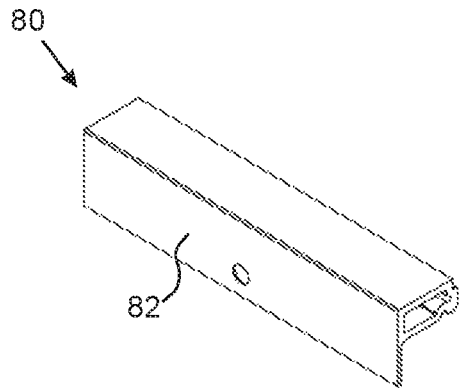
Figure 14C:
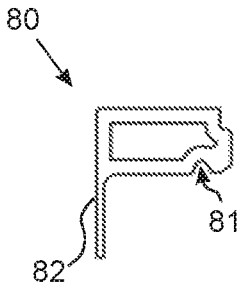
Figure 14D:
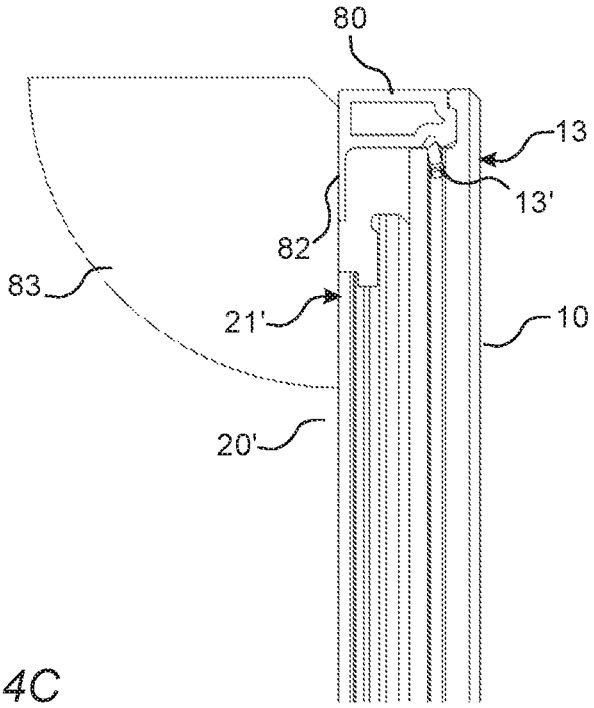

FIGS. 14A-14C show a moulding 80 suitable for use with the set 60, for example when assembled to form a wall 59. In particular, the moulding 80 may be used in proximity of a ceiling whereby a further moulding 83, such as a decorative moulding may be attached to a front side 82 of the batten 80.

The moulding 80 may be configured to engage with the third edge 13 of the first building element 10, such as a short side as shown in FIG. 12D. In this particular example the third edge 13 comprises a flexible tongue 13' adapted to cooperate with a groove 81 of the moulding 80 for locking, such as by means of a snap-in function, the moulding 80 to the third edge 13 of the first building element 10.

Figure 15A:
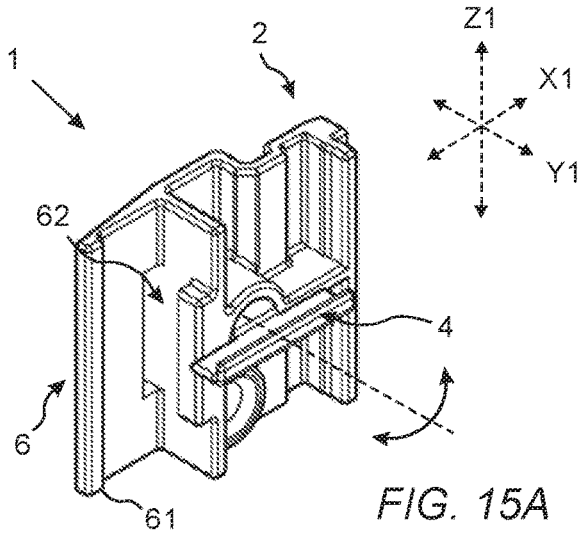
FIGS. 15A-15B show isometric views of a coupling element according to an embodiment.
Figure 15B:
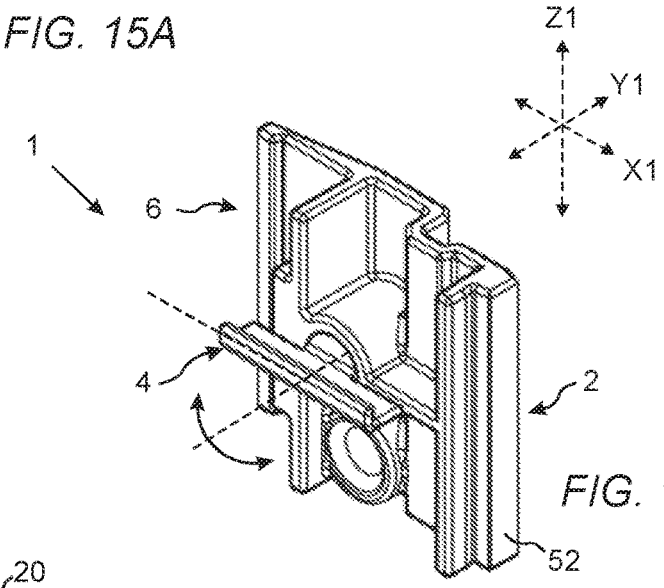
Figure 15C:
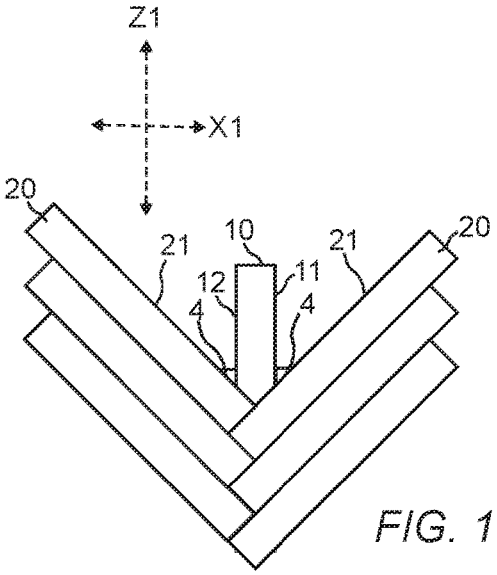
FIG. 15C shows an exemplary herringbone pattern according to an embodiment.

FIGS. 15A-15B show a further embodiment of the inventive concept configured for assembling a wall of panels, where the first edge 11 of the first building element 10 and the first edge 21 of the first panel 20 extend with a relative angle, such as when the first panels 20, 20' are arranged in a herringbone pattern, i.e., the first panel 20 and the second panel 20' may be arranged transverse each other, and each of the first panel and the second panel 20' being arranged with a 45-degree angle relative the first building element 10. As derivable from FIGS. 15A-15B, for the purpose of assembling a first edge 11 of the first building element 10 and a first edge 21 of a first panel 20 when the first edges 11, 21 forms an angle, such as 45 degrees, the secondary coupling portion 4 is pivotably or rotatably attached to the main body 5 of the coupling element and rotatable about an axis 4*x* extending along the tertiary axis Y1, as shown in FIGS. 15A-15B. An exemplary herringbone pattern assembled by means of the embodiment of FIGS. 15A-15B or FIGS. 16A-16B is shown in FIG. 15C. Thus, the secondary coupling portion 4 in this embodiment may be rotated about the axis 4*x* to match the applicable angle, such as 45-degrees between the first edge 11 of the first element 10 and the first edge 21 of the first panel 20 and/or a 45-angle between the second edge 12 of the first element 10 and the first edge 21 of the first panel 20 as shown in FIG. 15.C.

Figure 16A:
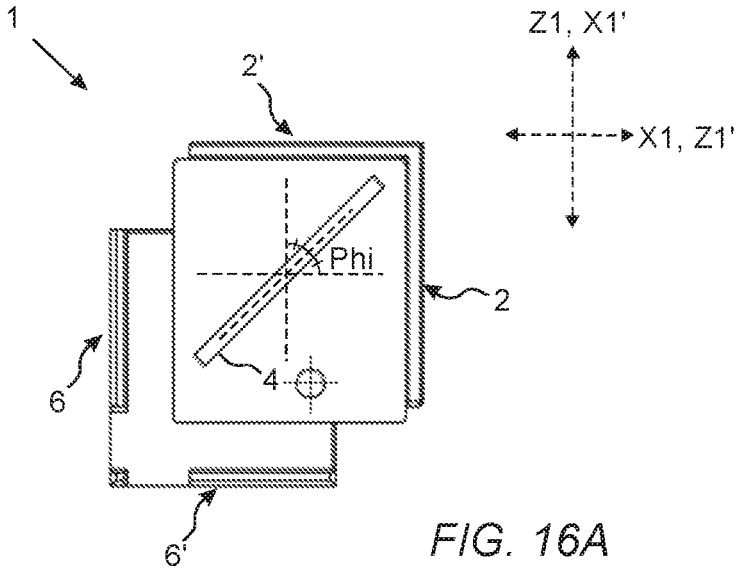
FIG. 16A shows a front view of a coupling element according to an embodiment.
Figure 16B:
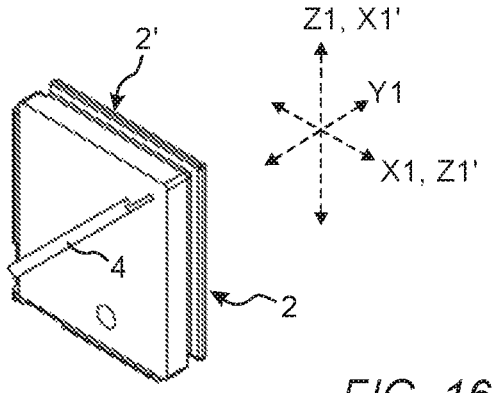
FIG. 16B shows a perspective view of the coupling element of FIG. 14A.
Figure 16C:
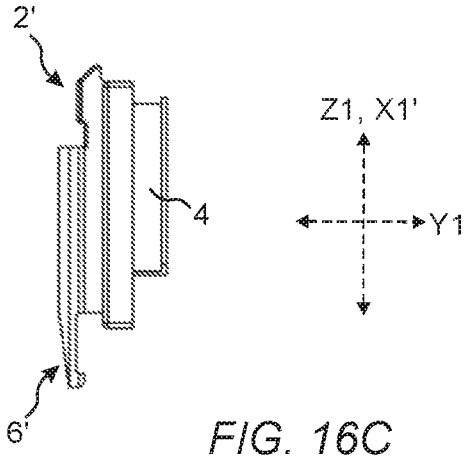
FIG. 16C shows a side view of the embodiment of FIG. 14A.
Figure 17A:
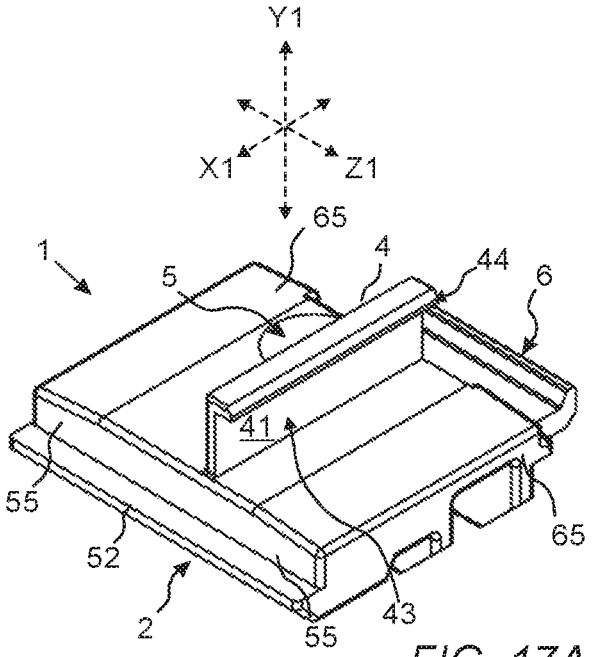
FIGS. 17A-17B show isometric views of an exemplary design of the coupling element according to the embodiment of FIGS. 7A-7C.
Figure 17B:
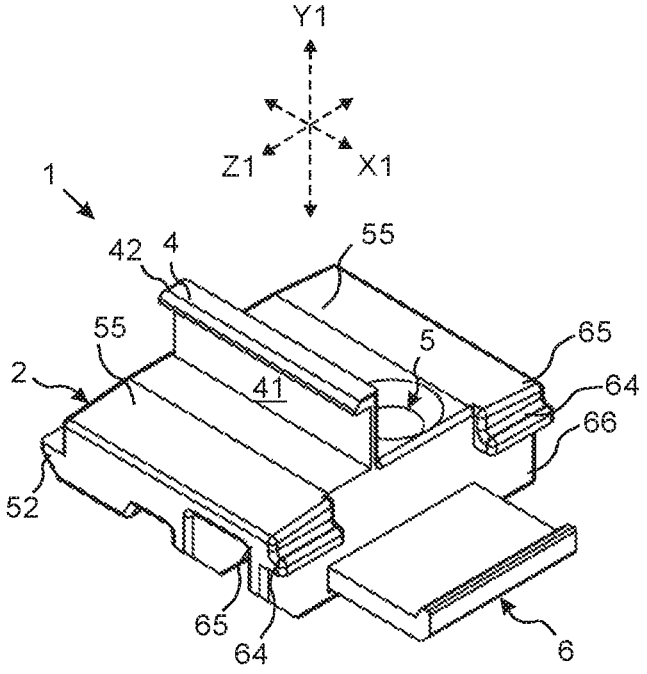

FIGS. 16A-16C show a further embodiment of the inventive concept configured for assembling a wall of panels, where the panels are arranged in a herringbone pattern. The coupling element comprising a primary coupling portion 2, 2' 6, 6' extending along a primary axis Z1, Z1' and configured to obtain an engaged state with a parallel first edge 11 of the first building element 10 for locking displacement of the coupling element 1 along the secondary axis X1, X1' and preferably the tertiary axis Y1 being orthogonal the primary axis Z1, Z1'; and a secondary coupling portion 4 extending along the tertiary axis Y1 and configured to engage with a first edge 21 of said first building panel 20.

Wherein the first edge 21 of the first panel 20 is provided with an angle Φ, such as 45-degree angle or 135-degree angle, relative the first edge 11 of the first building element 10.

The secondary coupling portion 4 may be configured to extend along and engage with a portion of the first edge 21 of the first panel 20.

As seen from FIGS. 16A-16C, in this embodiment the coupling element 1 comprises four coupling primary portions 2,6, 2',6', each extending along an edge of the coupling portion 1. The first and third primary coupling portions 2, 2' may correspond to the first coupling portion of the embodiment of for example FIGS. 2C-2D and the second and fourth coupling portions 6, 6' may correspond to the second secondary coupling portion of the embodiment of for example FIGS. 2C-2D.

The coupling element 1 may comprise a general rectangular shape, such as substantially quadratic.

Two adjacent edges may comprise the first 2 and third 2' primary coupling portions and two diagonally opposite adjacent edges may comprise the second 6 and fourth 6' primary coupling portions.

This configuration brings about the technical advantage that the coupling element 1 may engage with the first 11 or second edge 12 of the first building element 10 and simultaneously engage with the second edge 22 of the second building element 20 arranged with an angle Φ (Phi), such as 45-degrees, relative the first 11 or second edge 12 of the first building element 10, alternatively, relative the primary axis Z1, Z1'.

Although the present inventive concept has been described and illustrated in detail, it is clearly understood that the same is by way of illustration and example only and is not to be taken by way of limitation, the spirit and scope of the present inventive concept being limited only by the terms of the appended claims.

Items

ITEM 1. A set comprising a coupling element 1, a first building element 10, a first building panel 20 and a second building panel 20', wherein the coupling element 1 is configured for assembling the first building panel 20 and the second building panel 20' to the first building element 10, wherein the coupling element 1 comprises a primary coupling portion 2, 6 extending in a direction along a primary axis Z1, Z1' and configured to cooperate with a first mechanical locking system 70 of a first edge 11 of the first building element 10 extending along the primary axis Z1, Z1', to obtain an assembled state therewith by means of a folding displacement of the coupling element 1 about the primary axis Z1, Z1' to thereby lock the coupling element 1 from displacement along a secondary axis X1, X1' and a perpendicular tertiary axis Y1 each being orthogonal the primary axis Z1; and wherein the coupling element 1 comprises a secondary coupling portion 4 extending in a direction along the tertiary axis Y1 and configured to cooperate with a second mechanical locking system 70' of respective first and opposite second edges 21, 22, 21', 22' of the first and second building panels 20, 20', wherein the second locking system 70' is configured for locking the first and second panels 20, 20' in a direction transverse of the plane of the proximal surface 25, 25' by means of a folding displacement of the second panel 20' about its second edge 22';

wherein the second locking system 70' of said second edge 22' comprises a locking groove 115' which opens in a direction along the tertiary axis Y1 in assembled state of the first and second panels 20, 20', said locking groove configured to receive a locking element 110' of the second locking system 70' of the first edge 21 of the first panel 20, said locking element 110' extending in a direction along the tertiary axis Y1; and wherein said locking element 110' is received in said locking groove 115' by means of said folding displacement of the second panel 20' about its second edge 22' to thereby lock the second panel 20' and the first panel 20 from parting away in a direction of the plane of the proximal surface 25 and transverse the second edge 22 of the first panel 20.

ITEM 2. The set according to item 1, wherein the secondary coupling portion 4 comprises a first portion 41 extending along the tertiary axis Y1 and a contiguous second portion 42 extending along the primary axis Z1 in assembled state, said second portion 42 configured to engage with said locking element 110' of said first building panel 20.

ITEM 3. The set according to the previous item, wherein said second portion 42 is configured to, in assembled state, engage with a top surface 114', in the direction of the tertiary axis Y1, of said locking element 110' of the first edge 21 of the first panel 20.

ITEM 4. The set according to any one of the preceding items 2 or 3, wherein the first portion 41 is configured to extend between, preferably clamped between, an outermost edge surface 113' of the first edge 21 of the first building panel 20, and an outermost edge surface 116' of the second building panel 20', in assembled state of the first and second panels 20, 20'.

ITEM 5. The set according to any one of the preceding items, wherein the locking groove 115' is configured to receive said second portion 42.

ITEM 6. The set according to any one of the preceding items, wherein the first locking system 70 and the second locking system 70' are essentially identical or identical locking systems.

ITEM 7. The set according to any one of the preceding items, wherein the first building element is a joist and/or a building panel, such as a floor panel, a wall panel, a ceiling panel.

ITEM 8. The set according to any one of the previous items, wherein the first edge 11 of the first building element 10 extends from a proximal surface 15 to a distal surface 16 of the first building element 10 and faces in a direction generally in the plane of the secondary axis X1, X1' and the primary axis Z1, Z1' towards the first coupling portion 2, 6 the assembled state.

ITEM 9. The set according to any one of the previous items, wherein the coupling element 1 comprises a main body 5, said body comprising the primary coupling portion 2, 6, said body being arranged on a distal side of said proximal surface 15 of said first building element 10 in assembled state.

ITEM 10. The set according to any one of the previous items, wherein the secondary coupling portion 4 extends from said body 5 to a proximal side of said proximal surface 15 of said first building element 10 in engaged state.

ITEM 11. The set according to any one of the previous items, wherein a second edge 22' of the second building panel 20' comprises a locking tongue 121 configured to be received in a tongue groove 111' of the first edge 21 of the first building panel 20 in response to said folding displacement of the second building panel 20' about its second edge 22' for locking of the second panel 20' to the first panel 20 in a direction transverse of the plane of the proximal surface 25, 25'.

ITEM 12. The set according to any one of the previous items, wherein a first primary coupling portion 2 comprises a locking groove 54 which opens in a direction along the tertiary axis Y1 in engaged state of the first panel 20 and being configured to receive a locking element 110 of the first edge 11 of the first building element 10 by means of a folding displacement of the coupling element about the primary axis Z1 for locking of the coupling element 1 and the first building element 10 from parting in a direction along the secondary axis X1, wherein said locking element 110 extends in a direction along the tertiary axis Y1.

ITEM 13. The set according to any one of the previous items, wherein a first primary coupling portion 2 of the coupling element 1 comprises a locking tongue 52 configured to be received in a tongue groove 111 of the second edge 12 of the first building element 10 by means of a folding displacement of the coupling element 1 about the primary axis Z1 for locking of the coupling element 1 and the first building element 10 from parting in a direction along the secondary axis Z1.

ITEM 14. The set according to any one of the previous items, wherein said primary coupling portion 2, 6 comprises a locking element 51, 61 extending in a direction along the tertiary axis Y1.

ITEM 15. The set according to any one of items 1 or 2, wherein said first edge 11 and preferably a second edge 12 of said first building element 10 comprises a locking element 110, 120 extending in a direction along the tertiary axis Y1 when the first building element 10 is configured in assembled state with the coupling element 1.

ITEM 16. The set according to any one of the preceding items, wherein said first building element 10 comprises a first mechanical locking system 70 for mechanical locking of one or more of similar panels in the plane of the proximal and/or distal surface 15, 16.

ITEM 17. The set according to any one of the preceding items, wherein said first panel 20 comprises a second mechanical locking system 70' for mechanical locking of one or more of similar panels in the plane of the proximal and/or distal surface 15, 16.

ITEM 18. The set according to any one of the preceding items, wherein said mechanical locking systems 70, 70' are configured for mechanical locking of one or more of similar adjacent building elements, such as building panels, in a direction of the plane of the proximal and/or distal surface.

ITEM 19. The set according to any one of the preceding items, wherein said mechanical locking system 70, 70' is configured for mechanical locking of one or more of similar building elements, such as building panels, in a direction of the plane of the proximal 15, 25 and/or distal surface 16, 26 and vertical locking normal the plane of the proximal 15, 25 and/or distal surface 16, 26.

ITEM 20. The set according to any one of the preceding items, wherein primary coupling portion 2, 6 comprises a shape corresponding to a second edge 12 of the first building element 10 or a first edge 21 of the first panel 20.

ITEM 21. The set according to any one of the preceding items, wherein one of the first edge 11, 21 or second edge 12, 22 of at least one of the first building element 10 and/or first panel 20 comprises a locking tongue 121 and the other of the first edge 11, 21 or second edge 12, 22 of said first building element 10 or first panel 20 comprises a corresponding tongue groove 111 for receiving a corresponding locking tongue.

ITEM 22. The set according to the preceding item 21, wherein one of said primary coupling portions 2 comprises said corresponding locking tongue 52.

ITEM 23. The set according to one of the preceding items 15 to 16, wherein one of said primary coupling portions 6 comprises a corresponding tongue groove 62.

ITEM 24. The set according to any one of the preceding items, wherein the first building element and said first panel comprise two essentially identically formed panels.

ITEM 25. The set according to any one of the preceding items, wherein the panels are identical panels in terms of the shape thereof, said panels provided with a mechanical locking system 70, 70' for locking two similar panels, such as the first building element 10 and the first panel 20, in a plane, such as a horizontal plane H or a vertical plane V.

ITEM 26. The set according to any one of the preceding items, wherein the first and first panels 10, 20 comprise the same locking system.

ITEM 27. The set according to any one of the preceding items, wherein the first and second locking systems 70, 70' are identical locking systems.

ITEM 28. The set according to any one of the preceding items, wherein the primary coupling portion and/or the secondary coupling portion is adapted to cooperate with said mechanical locking system 70 by being formed to correspond to one or more of the edges of the mechanical locking system.

ITEM 29. The set according to any one of the preceding items, wherein the first edge 11 of the first building element 10 is configured to cooperate with an outer edge of the first panel 20 for locking the first element and first panel 10, 20 in the plane of the primary axis Z1 and the secondary axis X1.

ITEM 30. The set according to any one of the preceding items, wherein the second edge 12 of the first building element 10 is configured to cooperate with an outer edge of the first panel 20 for locking the first building element 10 and the first panel 20 in the plane of the primary axis Z1 and the secondary axis X1.

ITEM 31. The set according to any one of the preceding items, wherein the outer edges 11, 12, 13, 14, 21, 22, 23, 24 extend between the respective proximal surface 15, 25 and the respective distal surface 16, 26 of the first building element 10 and the first panel 20.

ITEM 32. The set according to any one of the preceding items, wherein the outer edges 11, 12, 13, 14, 21, 22, 23, 24 extend along the tertiary axis Y1 between the respective proximal surface 15, 25 and the respective distal surface 16, 26 of the first building element 10 and the first panel 20 in the assembled state of the respective first building element 10 and first panel 20.

ITEM 33. The set according to any one of the preceding items, wherein one or more coupling portions of the coupling element 1 comprises an edge profile corresponding to one or more of the edges 11, 12, 13, 14, 21, 22, 23, 24 of a building element, such as the first building element 10 and/or the first panel 20.

ITEM 34. The set according to any one of the preceding items, wherein the second edge 12 of the first building element 10 comprises a locking tongue 121 configured to be received in a corresponding tongue groove 62 of the second primary coupling portion 6 of the coupling element 1.

ITEM 35. The set according to any one of the preceding items, wherein the coupling element is configured such that it cannot engage with the first edge 11 of the first building element 10 by linear displacement exclusively in a direction along the secondary axis X1, such as in a direction transverse the first edge 11 and straight towards the first edge 11.

ITEM 36. The set according to any one of the preceding items, wherein the engaging of the coupling element with the first edge of the first building element comprises the locking element of the primary coupling portion and the locking element of the first building element being configured to extend in opposite directions along the tertiary axis and overlap in engaged state of the first building element.

ITEM 37. The set according to any one of the preceding items, wherein the locking element 51 of the first primary coupling portion 2 cooperates with the locking element 110 of the first edge 11 of first building element 10, said locking elements 51 and 110 extending in substantially opposite directions to facilitate locking of the coupling element 1 along the secondary axis X1.

ITEM 38. The set according to any one of the preceding items, wherein locking of the first panel 20 and a second panel 20' involves folding of the second panel 20'.

ITEM 39. The set according to any one of the preceding items, wherein the first panel comprises a mechanical locking system for mechanical locking of one or more of similar adjacent panels in a direction of the plane of the proximal surface such that the panels are adapted to be laid as a wall, such as a floating wall with the mechanical locking system functioning as a vertical locking system.

ITEM 40. The set according to any one of the preceding items, wherein the secondary coupling portion 4 of the coupling element 1 is configured to cooperate with the locking system 70' of the first panel 20 and the locking system 70' of a second panel 20'.

ITEM 41. The set according to any one of the preceding items, wherein the coupling element comprises a hook or hitch 44 comprised of a first portion 41 extending in a direction along the tertiary axis Y1 and a second portion 42 extending in a direction along the primary axis Z1 and being configured to engage with an outer edge of the second building panel 20, preferably an outermost edge surface 113', wherein said outer edge 22 comprises a locking element 110' extending in a direction normal to the proximal surface 25 of the first panel 20.

ITEM 42. The set according to any one of the preceding items, wherein said locking element 110' comprises a locking surface 112' extending substantially in a direction along the tertiary axis Y1.

ITEM 43. The set according to any one of the preceding items, wherein said proximal surface 15 of the first building element 10 is arranged in a primary plane V1 and a corresponding proximal surface 25 of the first panel 20 is arranged in a parallel secondary plane V2 displaced from the primary plane V1 in a respective engaged state of the first element and/or first panel 10, 20.

ITEM 44. The set according to any one of the preceding items, wherein said first building element 10 and said first panel 20 comprises two essentially identically formed panels, such as panels suitable to be laid as a floor.

ITEM 45. The set according to any one of the preceding items, further comprising attachment means, preferably comprising a through-hole 82, for attachment of said coupling element 1 to a substrate 45.

ITEM 46. The set according to any one of the preceding items, wherein a secondary coupling portion 4 is pivotably arranged relative the primary coupling portion 2, 6.

ITEM 47. The set according to any one of the preceding items, wherein the secondary coupling portion 4, 8 comprises an extension parallel with or with an angle θ (Phi) relative the secondary axis X1, X1', such as a 45-degree angle, in engaged state of the first building element 10.

ITEM 48. The set according to any one of the preceding items, wherein one or more secondary coupling portions 8', 8" are configured to be received in one or more longitudinally L extending grooves 46 provided on the distal surface 26, 26' of the first panel 20 and/or a second panel 20' facing the first building element 10.

ITEM 49. Method 100 of assembling a first building panel 20 and a second building panel 20' to a first building element 10, comprising:

providing one or more first building elements 10, each comprising a first edge 11;

providing one or more coupling element 1, said element comprising:

a primary coupling portion 2, 6 extending along a primary axis Z1, Z1' and being configured to cooperate with a first mechanical locking system 70 of the first edge 11 of the first building element 10 to obtain an engaged state with said first edge 11 by means of a folding displacement of the coupling element 1 about the primary axis Z1, Z1';

a secondary coupling portion 4 comprising a first portion 41 extending in a direction along the tertiary axis Y1 and a contiguous second portion 42 extending in a direction along the primary axis Z1, said secondary coupling portion 4 configured to cooperate with a second mechanical locking system 70' of the first panel 20, wherein said second mechanical locking system 70' configured for horizontal and vertical locking with an essentially identical second panel 20';

folding the coupling element 1 about the primary axis Z1, Z1' to thereby lock the coupling element 1 from displacement along a secondary axis X1, X1' and a perpendicular tertiary axis Y1 each being orthogonal the primary axis Z1; and displacing the coupling element 1 along the first edge 11 of the first building element 1 to a position where the second portion 42 of the second coupling portion 4 engages with a locking element 110' of a first edge 21 of the first panel 20, said locking element extending in a direction along the tertiary axis Y1;

providing a second building panel 20' comprising a second edge 22 with a locking groove 115' which opens in a direction along the tertiary axis Y1;

folding said second building panel 20' about its second edge 22 to thereby arrange said locking element 110' in said locking groove 115', whereby the first building panel 20 and the second building panel 20' are locked from parting away from each other in a direction of the plane of the proximal surface 25 and transverse the first edge 21 of the first panel 20.

ITEM 50. The method according to the previous item, wherein the first edge 11 of the first building element 10 extends from a proximal surface 15 to a distal surface 16 of the first building element 10 in a direction along a tertiary axis Y1 and faces in a direction generally along a secondary axis X1, X1' towards the first coupling portion 2, 6 in engaged state, said first edge 11.

ITEM 51. The method according to the previous item, wherein the first and second edges 21, 22 of the first panel 20 extend between respective proximal and distal surfaces 25, 26 of the first panel 20 and comprises the second locking system 70'.

ITEM 52. The method according to the previous item, wherein a second edge 22' of the second panel 20' comprises a locking tongue 121 configured to be received in a tongue groove 111' of the first edge 21 of the first panel 20 by means of the step of folding the second panel 20' about its second edge 22' for locking of the first panel 20 and the second panel 20' in a direction transverse the proximal surface 25, 25'.

The invention claimed is:

1. A set comprising:

a coupling element, a first building element, a first building panel and a second building panel, wherein the coupling element is configured for assembling the first building panel and the second building panel to the first building element, wherein the coupling element comprises a primary coupling portion extending in a direction along a primary axis and configured to cooperate with a first mechanical locking system of a first edge of the first building element extending along the primary axis, to obtain an assembled state therewith by means of a folding displacement of the coupling element about the primary axis to thereby lock the coupling element from displacement along a secondary axis and a perpendicular tertiary axis each being orthogonal to the primary axis;

wherein the coupling element comprises a secondary coupling portion extending in a direction along the tertiary axis and configured to cooperate with a second mechanical locking system of respective first and opposite second edges of the first and second building panels;

wherein the second mechanical locking system is configured for locking the first and second building panels in a direction transverse of a main plane of a proximal surface of the first building panel by means of a folding displacement about the second edge of the second building panel;

wherein the second mechanical locking system of said second edge comprises a locking groove which opens in a direction along the tertiary axis in the assembled state of the first and second building panels, said locking groove configured to receive a locking element of the second mechanical locking system of the first edge of the first building panel, said locking element extending in the direction along the tertiary axis;

wherein said locking element is received in said locking groove by means of said folding displacement about the second edge of the second building panel to thereby lock the second building panel and the first building panel from parting away in the direction of the main plane of the proximal surface and transverse the second edge of the first building panel; and wherein the first mechanical locking system is identical to the second mechanical locking system.

2. The set according to claim 1, wherein the tertiary axis extends orthogonally to the main plane of the first building panel in the assembled state of the first and second panels.

3. The set according to claim 1, wherein the locking groove is configured to receive said secondary coupling portion.

4. The set according to claim 1, wherein the first building element is a joist or a building panel.

5. The set according to claim 1, wherein the first edge of the first building element extends from the proximal surface to a distal surface of the first building element and faces in a direction substantially in a plane of the secondary axis and the primary axis towards the first coupling portion in the assembled state.

6. The set according to claim 1, wherein a second edge of the second building panel comprises a locking tongue configured to be received in a tongue groove of the first edge of the first building panel in response to said folding displacement about the second edge of the second building panel for locking of the second building panel to the first building panel in the direction transverse of the plane of the proximal surface.

7. The set according to claim 1, wherein the primary coupling portion is a first primary coupling portion which comprises a locking groove which opens in the direction along the tertiary axis and being configured to receive a locking element of the first edge of the first building element by means of a folding displacement of the coupling element about the primary axis for locking of the coupling element and the first building element from parting in a direction along the secondary axis, wherein said locking element extends in the direction along the tertiary axis, wherein the tertiary axis extends orthogonally to the main plane of the first building panel in the assembled state of the first and second panels.

8. The set according to claim 1, wherein the primary coupling portion is a first primary coupling portion of the coupling element which comprises a locking tongue configured to be received in a tongue groove of a first edge of the first building element by means of a folding displacement of the coupling element about the primary axis for locking of the coupling element and the first building element from parting in a direction along the secondary axis.

9. The set according to claim 1, wherein the primary coupling portion is a first primary coupling portion, and wherein a second edge of the first building element comprises a locking groove which opens in the direction along the tertiary axis and being configured to receive a locking element of a second primary coupling portion by means of a folding displacement of the coupling element about the primary axis for locking of the coupling element and the first building element from parting in a direction along the secondary axis, wherein said locking element extends in the direction along the tertiary axis, wherein the tertiary axis extends orthogonally to the main plane of the first building panel in the assembled state of the first and second panels.

10. The set according to claim 1, wherein the primary coupling portion is a first primary coupling portion, and wherein a second edge of the first building element comprises a locking tongue configured to be received in a tongue groove of a second primary coupling portion by means of a folding displacement of the coupling element about the primary axis for locking of the coupling element and the first building element from parting in a direction along the secondary axis.

11. The set according to claim 1, wherein the coupling element comprises a main body, said body comprising the primary coupling portion, said body being arranged on a distal side of proximal surface of said first building element in assembled state.

12. The set according to claim 11, wherein the secondary coupling portion extends from said body to a proximal side of said proximal surface of said first building element in engaged state.

13. The set according to claim 1, wherein the secondary coupling portion comprises a first portion extending along the tertiary axis and a contiguous second portion extending along the primary axis in assembled state, said second portion being configured to engage with said locking element of said first building panel.

14. The set according to claim 13, wherein said second portion is configured to, in assembled state, engage with a top surface, in the direction of the tertiary axis, of said locking element of the first edge of the first building panel.

15. The set according to claim 13, wherein the first portion is configured to extend between an outermost edge surface of the first edge of the first building panel, and an outer edge surface of the second building panel, in assembled state of the first and second building panels.

* * * * *